US008564210B2

(12) United States Patent
Hamamoto et al.

(10) Patent No.: US 8,564,210 B2
(45) Date of Patent: Oct. 22, 2013

(54) LIGHT SOURCE MODULE AND LIGHTING APPARATUS, AND ILLUMINATION APPARATUS USING SAME

(75) Inventors: Katunobu Hamamoto, Neyagawa (JP); Akira Horiguchi, Nara (JP); Hiroshi Sugawara, Amagasaki (JP); Kei Mitsuyasu, Hirakata (JP)

(73) Assignee: Panasonic Corporation, Osaka (JP)

( * ) Notice: Subject to any disclaimer, the term of this patent is extended or adjusted under 35 U.S.C. 154(b) by 234 days.

(21) Appl. No.: 12/929,950

(22) Filed: Feb. 28, 2011

(65) Prior Publication Data

US 2011/0210675 A1 Sep. 1, 2011

(30) Foreign Application Priority Data

Feb. 28, 2010 (JP) ..... 2010-043642
Mar. 17, 2010 (JP) ..... 2010-061132

(51) Int. Cl.
*H05B 37/02* (2006.01)

(52) U.S. Cl.
USPC ..... 315/185 R

(58) Field of Classification Search
USPC ..... 315/185 R, 185 S, 312, 291, 307, 224, 315/246; 361/611, 613, 630, 631, 217.12, 361/217.13, 217.17
See application file for complete search history.

(56) References Cited

U.S. PATENT DOCUMENTS

2006/0087843 A1* 4/2006 Setomoto et al. ..... 362/249
2008/0094837 A1* 4/2008 Dobbins et al. ..... 362/249
2009/0021185 A1* 1/2009 Ng ..... 315/294
2009/0085497 A1 4/2009 Osborn
2009/0102399 A1* 4/2009 Kita ..... 315/307
2009/0237011 A1* 9/2009 Shah et al. ..... 315/312

FOREIGN PATENT DOCUMENTS

| | | |
|---|---|---|
| CN | 2664204 | 12/2004 |
| JP | 2009-21175 | 1/2009 |
| JP | 2009-021175 | 1/2009 |
| JP | 2009-224046 | 10/2009 |
| JP | 2009-283281 | 12/2009 |

OTHER PUBLICATIONS

Chinese Office Action dated Sep. 31, 2012 and English translation thereof.

* cited by examiner

*Primary Examiner* — Minh D A
(74) *Attorney, Agent, or Firm* — Bacon & Thomas, PLLC

(57) ABSTRACT

A light source module includes a substrate unit for mounting multiple light emitting diodes thereon to electrically connecting them; first and second electrical connecting terminals for supplying a current to the light emitting diodes based on a voltage applied from outside the substrate unit; and a characteristic setting unit for presetting characteristic information corresponding to a electrical characteristic of the light emitting diodes. Further, the light source module includes a third electrical connecting terminal for outputting a setting signal based on the characteristic information preset in the characteristic setting unit, and the characteristic setting unit is connected at least between the third and first electrical connecting terminals or between the third and second electrical connecting terminals, and the characteristic setting unit responds to a set-up power inputted from the third electrical connecting terminal to generate the setting signal.

12 Claims, 29 Drawing Sheets

LIGHT SOURCE MODULE AND LIGHTING APPARATUS, AND ILLUMINATION APPARATUS USING SAME

FIELD OF THE INVENTION

The present invention relates to a light source module using light emitting diodes as a light source, a lighting apparatus for turning the light source module on/off and an illumination apparatus using the light source module and the illuminating device.

BACKGROUND OF THE INVENTION

Conventionally, fluorescent lamps have been mainly used as a light source for illumination, and illumination apparatuses turned on by using a high-frequency inverter switching device have been widely spread. Recently, light emitting diodes (LEDs) are spotlighted as an electrical light source other than discharge lamps such as fluorescent lamps. In particular, since the LEDs have a relatively longer lifetime than fluorescent lamps, they are expected to become superior to the fluorescent lamp FHF32 mainly used for base lighting by future technological improvement.

As LED technology improves, there is developed a light source module with LEDs mounted thereon. In the light source module, it needs to determine both the number of the LEDs to use therein and whether to connect the LEDs in series or in parallel in order to achieve a constant light output from the light source module. That is, the number of the LEDs to use and the connection arrangement is determined in design of the light source module such that current and voltage values of the light source module are appropriately set.

Furthermore, a lighting apparatus for supplying current to the light source module is designed to generate an appropriate output to save power with improvement of LED technology. However, as described above, the current and voltage values of the light source module vary depending on electrical characteristics of each LED, the number of the LEDs in use and whether the LEDs are connected in series or in parallel. Despite the improvement of LED technology, the light source module needs to be designed to have a specific combination of the characteristics of each LED, the number of LEDs in use and the connection arrangement by which can generate constant current.

For example, when an LED with a voltage characteristic of 3.5 V is used, a lighting apparatus applies a voltage of 17.5 (=3.5×5) V to a light source module (hereinafter, referred to as an "LED module") having 5 LEDs with this characteristic connected in series. If 4 LEDs with the same characteristic connected in series are connected to the illuminating device, an overvoltage is applied, resulting in over-current.

Japanese Patent Application Publication No. 2009-224046 (hereinafter, referred to as "Reference 1") discloses a notification terminal for notifying the connection and disconnection of an LED module as a means to prevent a breakdown caused by such excessive current, thereby preventing excessive current based on a notification signal from the notification terminal. Furthermore, Reference 1 discloses a configuration capable of providing a constant current to the LED module.

Reference 1 considers the difference in the number of the LEDs in use but does not consider the improvement of LED technology as mentioned above. For example, an LED with a voltage characteristic of 3.5 V and a current characteristic of 0.3 A is considered. The voltage applied to an LED module including 10 LEDs with such characteristics connected in series is 35 (=3.5×10) V and the output current thereof is 0.3 A. If an LED with a voltage characteristic of 3 V and a current characteristic of 0.2 A becomes available through the improvement of the LED technology, the voltage applied to an LED module having 8 LEDs with such characteristics connected in series becomes 24 (=3×8) V.

Therefore, when it is compared to the LED module including 7 LEDs with a voltage characteristic of 3.5 V connected in series to which a voltage of 24.5 (=3.5×7) V is applied, the application voltage difference caused by the differences in voltage characteristics and the number of the LEDs in use is not substantially large. However, if 0.3 A flows through an LED module with an output current of 0.2 A, abnormal heat is generated due to the over current, resulting in a breakdown or lifetime reduction.

In Japanese Patent Application Publication No. 2009-283281 (hereinafter, referred to as "Reference 2"), there are 3 types of LED modules, each being different in the number of LEDs connected in series. When one of the 3 LED modules is connected to an illuminating device, the lighting apparatus applies small current to the LED module and determines the type of the LED module based on a voltage drop in the LED module. Then, a voltage applied to the LED module from the lighting apparatus is controlled on the basis of the determination result. Therefore, Reference 2 has also the same problem as Reference 1.

In Japanese Patent Application Publication No. 2009-21175 (hereinafter, referred to as "Reference 3"), an LED module is provided with a storage unit for storing information on a current characteristic of the LED module which varies on type of LED module. When a lighting apparatus is connected to the LED module, an information monitoring unit of the lighting apparatus reads the information on the current characteristic from the storage unit of the LED module. Then, the lighting apparatus controls a voltage to apply to the LED module according to the current characteristic information read by the information monitoring unit.

By utilizing the technology disclosed in Reference 3, a lighting apparatus responding to future technological improvement of LEDs can be realized. In other words, the current applied to the LED module can be kept constant with no restriction on the characteristics or the number of LEDs or a connection arrangement of multiple LEDs.

However, in Reference 3, since an electrically programmable non-volatile semiconductor memory such as a flash memory is needed, manufacturing cost of the LED module increases. Furthermore, it is necessary to provide a signal line for reading the information from and a power line for supplying operational power to the storage unit in Reference 3. This makes wiring for connection between the LED module and the lighting apparatus complicated.

SUMMARY OF THE INVENTION

In view of the above, the present invention provides a light source module, a lighting apparatus and an illumination apparatus using the light source module and the lighting apparatus capable of responding to technological improvement of LEDs and being manufactured at low cost.

Furthermore, the present invention provides a lighting apparatus capable of turning on/off multiple types of light source modules with different electrical characteristics with a low manufacturing cost and simple wiring.

In accordance with a first aspect of the present invention, there is provided a light source module including a substrate unit for mounting multiple light emitting diodes thereon to electrically connecting them; first and second electrical connecting terminals for supplying a current to the light emitting diodes based on a voltage applied from outside the substrate unit; a characteristic setting unit for presetting characteristic information corresponding to a electrical characteristic of the light emitting diodes; and a third electrical connecting terminal for outputting a setting signal based on the characteristic information preset in the characteristic setting unit. In the light source module, the characteristic setting unit is connected at least between the third and first electrical connecting terminals or between the third and second electrical connecting terminals, and the characteristic setting unit responds to a set-up power inputted from the third electrical connecting terminal to generate the setting signal.

With this configuration, since the characteristic information on the electrical characteristics of the LEDs is preset in the characteristic setting unit, it is possible to cope with technological improvement of LEDs.

In accordance with a second aspect of the present invention, there is provided a lighting apparatus capable of turning on and off the light source module set forth in the first aspect, the lighting apparatus including; a voltage conversion unit having at least one switching element and being adapted to receive a rectified voltage as a power source, convert the rectified voltage to a desired voltage by turning on and off the switching element and supply the desired voltage to the light source module, the rectified voltage being obtained by rectifying a direct-current voltage or an alternating-current voltage supplied from the outside; a set-up power output unit for supplying a set-up second power to the characteristic setting unit of the light source module via the third electrical connecting terminal; a characteristic detection unit connected to the third electrical connecting terminal of the light source module to detect the characteristic information; and a current detection unit connected to a lower potential terminal of the first and second electrical connecting terminals to detect a current including a load current flowing through the light source module and to generate a current detection signal.

The lighting apparatus further includes an output control unit for outputting a driving signal to the switching element to control the load current based on the detected result of the characteristic detection unit and the current detection signal, and a connection determination unit connected to the third electrical connecting terminal of the light source module to determines whether the light source module is connected or not, and the output control unit includes a stopping unit for stopping the output of the driving signal based on the determination result of the connection determination unit.

With this configuration, the lighting apparatus capable of stably turning on/off the LED module set forth in the first aspect can be realized.

In accordance with a third aspect of the present invention, there is provided an illumination apparatus including the light source module set forth in the first aspect and the lighting apparatus set forth in the second aspect.

In accordance with a fourth aspect of the present invention, there is provided a light source module including a first light source unit including multiple light emitting diodes connected in series in the forward direction; a second light source unit including multiple light emitting diodes connected in parallel, the anode of each light emitting diode being connected to the cathode of the head light emitting diode of the first light source unit; a positive connecting terminal connected to the anode of the tail light emitting diode of the first light source unit; a first negative connecting terminal connected to the cathode of at least one light emitting diode of the second light source unit; and a second negative connecting terminal connected to the cathode of at least one light emitting diode among the multiple light emitting diodes of the second light source unit which is not connected to the first negative connecting terminal.

The light source module further includes a characteristic setting unit for setting information about electrical characteristics of the light emitting diodes of the first and the second light source units, the characteristic setting unit being connected between the first and second negative connecting terminals, and a power is applied between the first positive connecting terminal and the first negative connecting terminal or the second negative connecting terminal by a lighting apparatus, a direct-current voltage is applied between the first and second negative connecting terminals from an outside power supply, and the characteristic setting unit includes a full-wave rectifier disposed the first and second negative connecting terminal and controls a voltage waveform inputted through the full-wave rectifier based on the information.

The light source module may include a third light source unit including multiple light emitting diodes connected in parallel, the cathode of each light emitting diode being connected to the anode of the tail light emitting diode of the first light source unit, and a second characteristic setting unit for presetting the same information as that preset in the characteristic setting unit.

Further, the positive connecting terminal may include a first positive connecting terminal connected to the anode of at least one light emitting diode of the third light source unit, and a second positive connecting terminal connected to the anode of at least one light emitting diode among the multiple light emitting diodes of the third light source unit which is not connected to the first positive connecting terminal.

Furthermore, the second characteristic setting unit may be connected between the first and second positive connecting terminals, and the first and second positive connecting terminals may be respectively connected to the cathodes of at least two light emitting diodes among the multiple light emitting diodes of the second light source unit which are not connected to both the first and second negative connecting terminals, and the first and second negative connecting terminals may be respectively connected to the anodes of the at least two light emitting diodes among the multiple light emitting diodes of the third light source unit which are not connected to both the first and second positive connecting terminals.

In accordance with a fifth aspect of the present invention, there is provided a lighting apparatus capable of turning on the light source module set forth in the fourth or fifth aspect, the lighting apparatus including a voltage conversion unit for applying a direct-current power between the negative connecting terminal or the first negative connecting terminal or the second negative connecting terminal and the first positive connecting terminal or the second positive connecting terminal, both voltage and current of the direct-current power being varied; a set-up power supply unit for applying a direct-current voltage between the first and second negative connecting terminals or between the first and second positive connecting terminals; and a characteristic detection unit for detecting the electrical characteristic of the light emitting diodes preset in the characteristic setting unit based on the voltage waveform between the first and second negative connecting terminals or between the first and second positive connecting terminals.

The lighting apparatus further includes a connection determination unit for determining whether or not the light source module is connected based on the voltage between the first and second negative connecting terminals or between the first and second positive connecting terminals; and an output control unit for stopping outputting the direct-current power of the voltage conversion unit if the connection determination unit determines that the light source module is not connected and for controlling at least either the voltage or the current of the direct-current power of the voltage conversion unit based on the electrical characteristic preset in the characteristic detection unit if the connection determination unit determines that the light source module is connected.

In accordance with a sixth aspect of the present invention, there is provided an illumination apparatus including an apparatus main body for receiving the lighting apparatus set forth in the sixth aspect; and a socket disposed at the apparatus main body and adapted to detachably install the light source module set forth in the fourth or fifth aspect.

BRIEF DESCRIPTION OF THE DRAWINGS

The above and other features of the present invention will become apparent from the following description of preferred embodiments given in conjunction with the accompanying drawings, in which.

DETAILED DESCRIPTION OF THE PREFERRED EMBODIMENTS

Hereinafter, embodiments of the present invention will be described in more detail with reference to accompanying drawings which form a part hereof.

First Preferred Embodiment

Examples of a first preferred embodiment in accordance with the present invention will now be described.

Example 1

Figure 1:
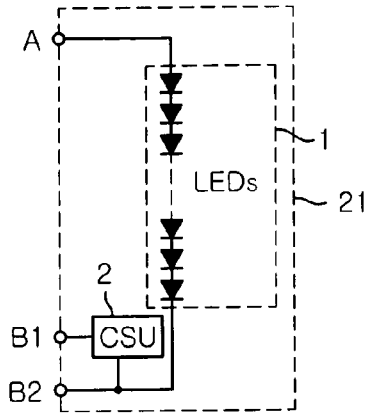
FIG. 1 is a circuit diagram of an LED module in accordance with a first example of a first preferred embodiment of the present invention.

Referring to FIG. 1, the LED module 21 includes a light source unit 1 in which a plurality of light emitting diodes (LEDs) are connected in series; and a characteristic setting unit (CSU) 2 for setting characteristic information of the LEDs, e.g., information corresponding to a targeted current value. A positive terminal of the light source unit is coupled to a connecting terminal A which can be electrically connected to or disconnected from a lighting apparatus disposed outside the LED module 21. A negative connecting terminal of the light source unit 1 is coupled to a connecting terminal B2. The characteristic setting unit 2 is connected between the low potential terminal (i.e., the negative connecting terminal) of the light source unit 1 and a connecting terminal B1.

Figure 3:
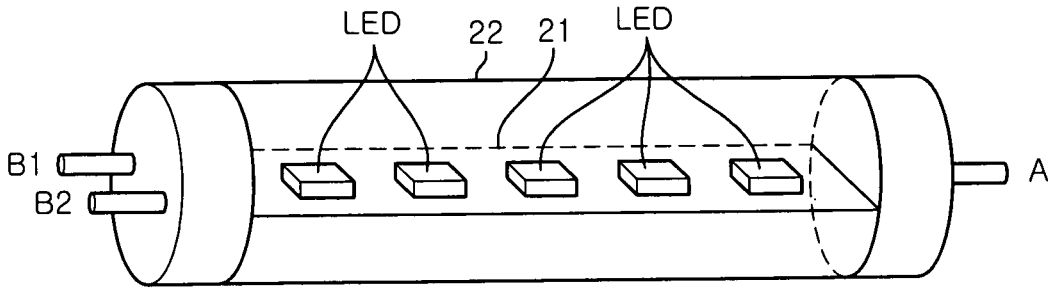
FIG. 3 is a perspective view illustrating a brief configuration of the LED module in accordance with the first example of the first preferred embodiment of the present invention.

FIG. 3 shows an exemplified configuration of the LED module 21. As shown in FIG. 3, one or more substrates having multiple light emitting diodes (LEDs) mounted thereon which form the light source unit 1 are coupled such that, if there are multiple substrates, surfaces of substrates are coplanar and a surface shape of the coupled substrates is rectangular and are received in a light-transmitting housing 22. The connecting terminal A is provided at one end of the housing 22, and the connecting terminals B1 and B2 are provided at the other end.

Although the characteristic setting unit 2 is not described in FIG. 3, it is mounted on the substrate close to the connecting terminal B1. The characteristic setting unit 2 is formed of electronic components which will be described below. The light source unit 1 and the characteristic setting unit 2 included in the LED module 21 are connected to a lighting apparatus via the connecting terminals A, B1 and B2, and a block diagram of the lighting apparatus is shown in FIG. 2.

Figure 2:
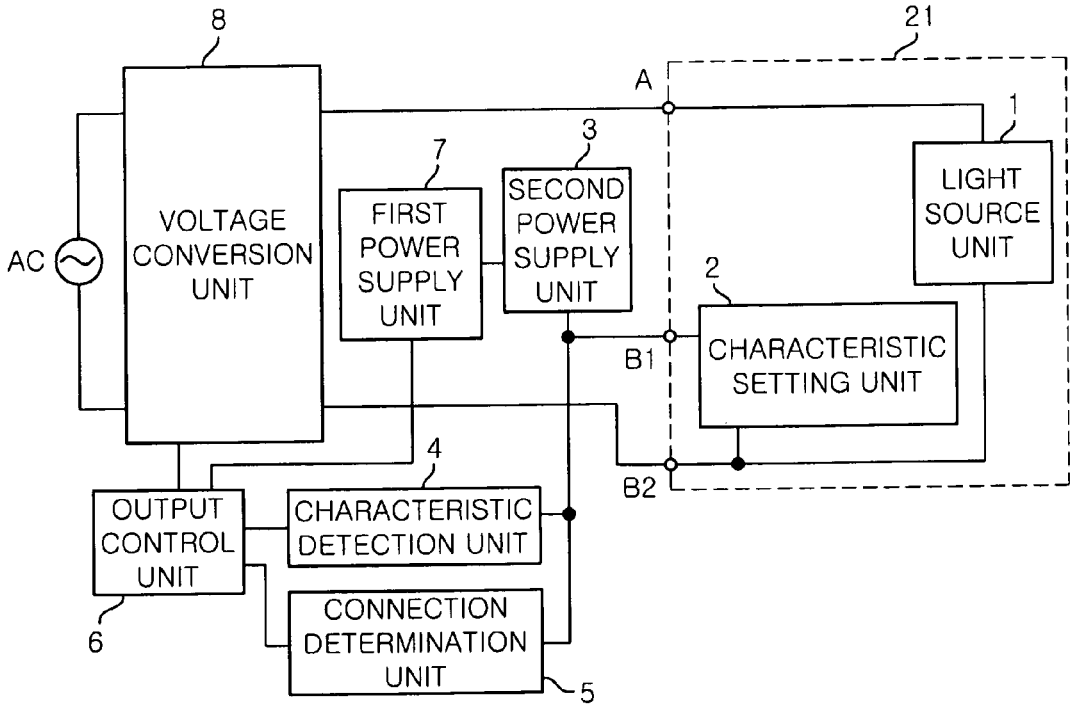
FIG. 2 shows a circuit diagram of a lighting apparatus in accordance with the first example of the first preferred embodiment of the present invention.

Referring to FIG. 2, the lighting apparatus includes a voltage conversion unit 8 having at least one switching element (not shown) for turning on/off the LED module 21 to supply current to the LED module 21. The lighting apparatus also includes an output control unit 6 for outputting a driving signal so that the voltage conversion unit 8 can provide a desired output; a first power supply unit 7 for supplying control power to circuits for controlling the output control unit 6 and the like; and a second power supply unit 3 for receiving the control power from the first power supply unit 7 and for supplying control power to the characteristic setting unit 2. Furthermore, the lighting apparatus further includes a characteristic detection unit 4 for detecting a waveform on a wire for supplying the control power to the characteristic setting unit 2 from the second power supply unit 3 and controlling the output control unit based on the detected result, and a connection determination unit 5 for determining the connection of the LED module 21 based on the waveform on the wire.

For example, each LED included in the light source unit 1 of the LED module 21, as shown in FIG. 1, has electrical characteristics: 0.3 A and 3.5 V. When 50 LEDs are connected in series, a current of 0.3 A is supplied to the light source unit 1 from the voltage conversion unit 8, the voltage between two terminals of the light source unit 1 becomes 175 (=3.5×50) V and power consumption of the light source unit 1 is 52.5 (=3.5×0.3×50) W.

The voltage conversion unit 8 may have any configuration only if it can provide direct-current power sufficient to turn the LED module 21 on and, for example, it may include, e.g., a voltage reduction chopper or a voltage reduction/boosting chopper.

The characteristic setting unit 2 stores current setting information. The voltage conversion unit 8 supplies a current to the LED module 21 at a desired value ranging, e.g., from 0.35 A to 0.10 A, based on the current setting information. In the example described above, since an output current of each LED included in the light source unit 1 is 0.3 A and, accordingly, the characteristic setting unit 2 stores 0.3 A of current setting information for the LED module 21 having the light source unit 1.

Figure 4:
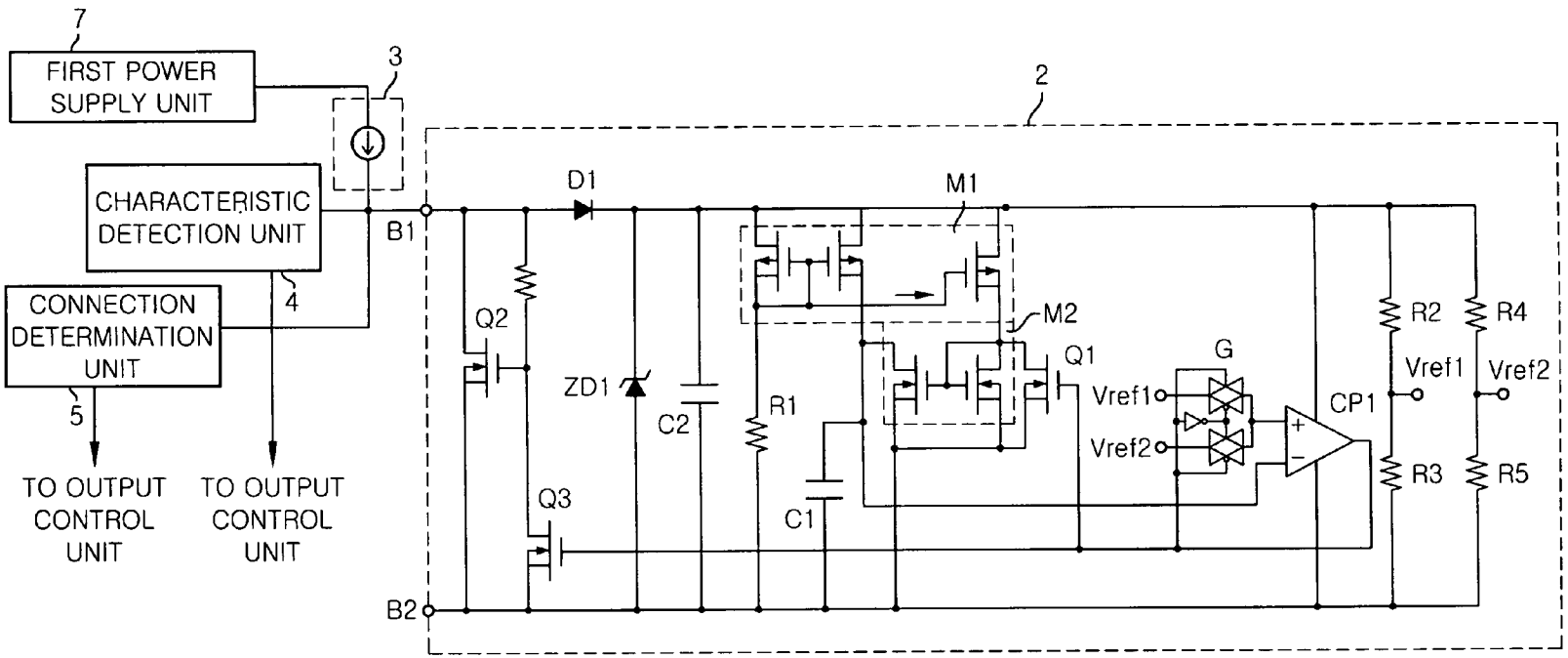
FIG. 4 describes a circuit diagram showing a detailed configuration of a characteristic setting unit in accordance with the first example of the first preferred embodiment of the present invention.

FIG. 4 shows a detailed configuration of the characteristic setting unit 2. In this example, the second power supply unit 3 is constituted by a current source and supplies control power to the characteristic setting unit 2 via the connecting terminal B1 as described above. Furthermore, the characteristic detection unit 4 and the connection determination unit 5 control the output control unit 6 based on the detected result from a waveform on the wire from the second power supply unit 3 to the connecting terminal B1.

The control power supplied from the second power supply unit 3 is applied between the connecting terminals B1 and B2 and thus it is applied to a parallel circuit of a Zener diode ZD1 and a capacitor C2 through a diode D1. The control power is clamped to Zener voltage Vz1 of the Zener diode ZD1 and at the same time it is smoothed by the capacitor C2. As shown in FIG. 4, Zener current flowing through the Zener diode ZD1 can be controlled to a desired value by adopting a constant current source as the second power supply unit 3. The Zener voltage Vz1 to which the control power supplied from the second power supply unit 3 is clamped is mainly applied to mirror circuits M1 and M2, a comparator CP1, a transfer gate circuit G, a series circuit of resistors R2 and R3 and a series circuit of resistors R4 and R5.

The reference voltage Vref1 is obtained by dividing the Zener voltage Vz1 by a resistive divider formed of the series circuit of the resistors R2 and R3. The reference voltage Vref2 is produced by dividing the Zener voltage Vz1 by a resistive divider formed of the series circuit of the resistors R4 and R5. The reference voltages Vref1 and Vref2 are fed to the positive input terminal of the comparator CP1 via the transfer gate circuit G. The mirror circuit M1 supplies current i1 determined by a resistor R1 to a capacitor C1 and the mirror circuit M2. Current i2 flowing through the mirror circuit M2 is set to be greater than the current i1 by changing a mirror ratio.

If a switching element Q1, which is turned on or off by an output signal of the comparator CP1, is on, the current i2 becomes zero and thus the current i1 flows to the capacitor C1. If the switching element Q1 is off, current i1-i2 becomes negative and thus current i2-i1 is drawn from the capacitor C1.

Figure 5:
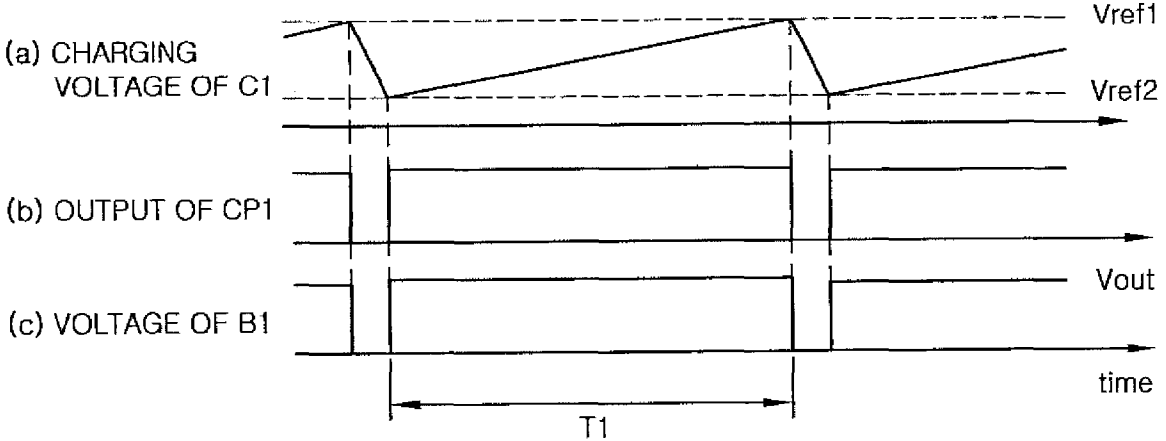
FIG. 5 provides a waveform chart for illustrating the operation of the characteristic setting unit in the first example of the first preferred embodiment in accordance with the present invention.

The voltage waveform of the capacitor C1 is determined by switching between the reference voltages Vref1 and Vref2 in the transfer gate circuit G based on the output voltage of the comparator CP1 shown in FIG. 5B and thus it becomes a triangular waveform with charging time T1 as shown in (a) of FIG. 5.

The output of the comparator CP1 is fed into the gate of a switching element Q3, and a switching element Q2 is turned on and off by turning the switching element Q3 on and off. Since the drain of the switching element Q2 is connected to the connecting terminal B1, both having same potential, the drain voltage of the switching element Q2, i.e., the voltage of the connecting terminal B1, has a waveform which has a high voltage level, i.e., an H level during a period of time approximately identical to the charging time T1 of the capacitor C1 as shown in (c) of FIG. 5.

If the switching element Q2 is turned off, the voltage of the connecting terminal B1 is Vout, the sum of the turn-on voltage of the diode D1 and the Zener voltage Vz1 of the Zener diode ZD1. If the switching element Q2 is turned on, the control current inputted from the second power supply unit 3 flows through the switching element Q2. Therefore, while the switching element Q2 is turned on, the circuit continues to operate by using the voltage charged in the smoothing capacitor C2.

Figure 6:
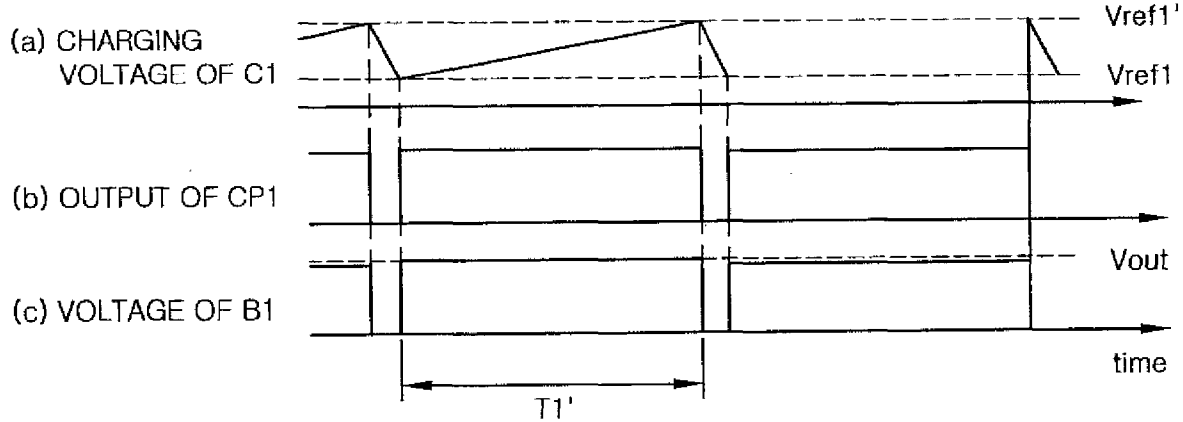
FIG. 6 offers a waveform chart for illustrating the operation of the characteristic setting unit having different characteristic information from that shown in FIG. 5 in the first example of the first preferred embodiment in accordance with the present invention.

If the reference voltage Vref1 produced by the series circuit of the resistors R2 and R3 is reduced to Vref1' by changing a voltage-dividing ratio between the resistors R2 and R3, the charging time of the capacitor C1 decreases from T1 to T1' as shown in (a) of FIG. 6. Further, the time period during which the drain voltage of the switching element Q2, i.e., the voltage of the connecting terminal B1, is at an H level, becomes almost identical to the reduced charging time T1' as shown in (c) of FIG. 6.

Figure 7:
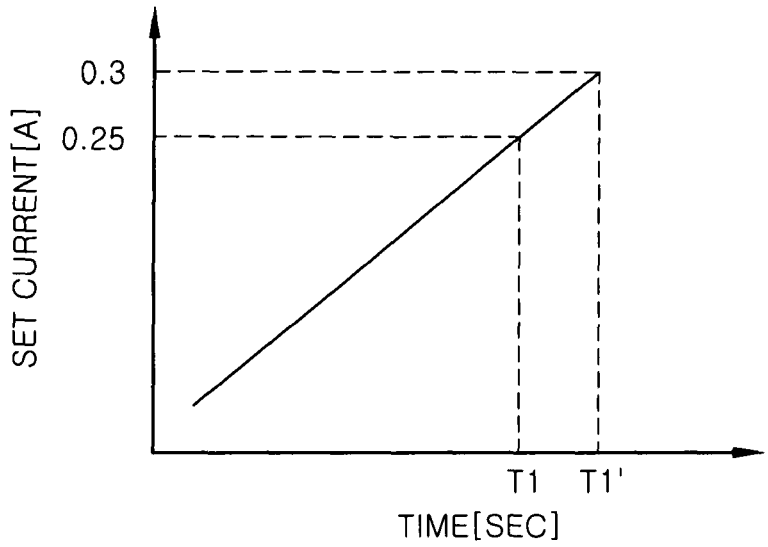
FIG. 7 is a view for describing the operation of a characteristic detection unit in accordance with the first example of the first preferred embodiment of the present invention.

The characteristic detection unit 4 is constituted by, e.g., a microcomputer and performs a process for measuring a time period during which the voltage at the connecting terminal B1 is at an H level. Then, the set current is calculated from the measured time period based on the relation as shown in FIG. 7. The set current may be read from a data table prepared in advance. The characteristic detection unit 4 sends an operation signal to the output control unit 6, thereby adjusting a supply current to the set current derived above.

For example, if an LED module 21 including 50 LEDs connected in series, each with electrical characteristics: 0.3 A and 3.5 V, is connected to the illuminating device, the set current is controlled such that the time period during which the voltage at the connecting terminal B1 is at an H level is set to be T1, as shown in (c) of FIG. 5, in the characteristic setting unit 2. On the other hand, if an LED module 21 including 40 LEDs connected in series, each with electrical characteristics: 0.25 A and 3.5 V, is connected to the illuminating device, the set current is controlled such that the time period during which the voltage of the connecting terminal B1 is at an H level is set to be T1', as shown in (c) of FIG. 6, in the characteristic setting unit 2.

Thus, the time period during which the voltage at the connecting terminal B1 is at an H level set in the characteristic setting unit 2 serves as information corresponding to the set current supplied to the LED module 21.

Like the characteristic detection unit 4, the waveform inputted to the connecting terminal B1 is fed to the connection determination unit 5, and operation of the connection determination unit 5 will be described. The connection determination unit 5 is constituted by, e.g., a comparator or a microcomputer' like in the characteristic detection unit 4 and detects the voltage of the connecting terminal B1. When the LED module 21 is connected to the illuminating device, the voltage of the connecting terminal B1 is the sum voltage Vout of the turn-on voltage of the diode D1 and the Zener voltage Vz1 of the Zener diode ZD1 as described above.

When the LED module 21 is not connected, the voltage of the connecting terminal B1 is not clamped by the Zener voltage Vz1 of the Zener diode ZD1 and is higher than the voltage Vout. By using this relationship, the connection determination unit 5 determines that the LED module 21 is disconnected if the voltage of the connecting terminal B1 is higher than the predetermined voltage Vref3.

If the connection determination unit 5 determines that the LED module 21 is not connected, then it sends a stop signal to the output control unit 6 to stop current supplied from the voltage conversion unit 8 to the LED module 1. At the same time, although not shown, it is desirable that the stop signal is sent to the characteristic detection unit 4 and, accordingly, the characteristic detection unit 4 stops detection of characteristic information or adjustment of the set current based on the information from the characteristic setting unit 2. If so, the characteristic detection unit 4 and the connection determination unit 5 may be constituted by a common microcomputer.

Figure 8:
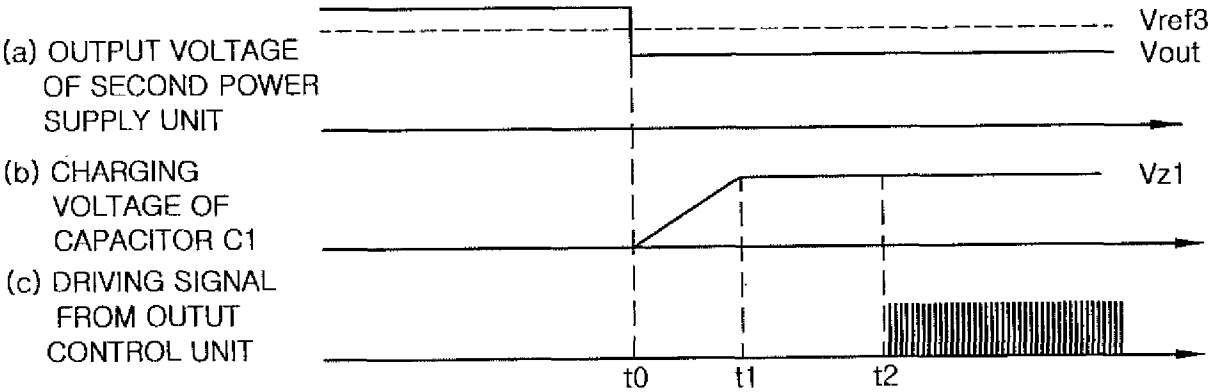
FIG. 8 provides a waveform chart for illustrating the operation of each unit when the operation starts in accordance with the first example of the first preferred embodiment of the present invention.

Timing charts shown in (a) to (c) of FIG. 8 describe the operation sequence when the LED module 21 is connected to the illuminating device. The LED module 21 is not connected until t0. At this time, the output voltage of the second power supply unit 3 is higher than the predetermined voltage Vref3 used to determine connection/non-connection of the LED module 21 as shown in (a) of FIG. 8. Thus, as shown in (c) of FIG. 8, a driving signal is not sent to the voltage conversion unit 8 from the output control unit 6.

When the LED module 21 is connected at t0, constant current for control power is supplied from the second power supply unit 3 to the characteristic setting unit 2 of the LED module 21 and the potential of the smoothing capacitor C2 gradually increases as shown in (b) of FIG. 8. At t1, the potential reaches the Zener voltage Vz1 of the Zener diode ZD1.

Meanwhile, during the time period from t0 to t1, the characteristic detection unit 4 might detect incorrect information due to the unstable operation of the characteristic setting unit 2. Therefore, from t0 when the LED module 21 is determined to be connected by the connection determination unit 5 to t1 when the operation of the characteristic setting unit 2 becomes stable, a timer is provided to stop information detection of the characteristic detection unit 4. After t1, the characteristic detection unit 4 starts information detection. Then, the output control unit 6 generates a driving signal at t2 when the information detection or the control of the set current is completed.

With this configuration, information corresponding to the characteristics of LEDs for use in the LED module 21 is prepared in advance and thus the lighting apparatus can supply the appropriate set current based on the information, thereby preventing a breakdown or lifetime reduction due to an over current flowing through the LEDs in use. Since the connection of the LED module 21 can be detected through the wire used to detect the characteristic information of the LED, wiring can be reduced. Furthermore, the operation of the lighting apparatus is stopped when the LED module 21 is not connected, resulting in no extra power consumption.

In this example, although the set current flowing through the LED module 21 has been described as the characteristic information of the characteristic setting unit 2, the characteristic information may include a voltage applied to the LED module 21.

The LED module 21 is not limited to the shape similar to a straight-tube fluorescent lamp as shown in FIG. 3 and may have any shape. For example, LEDs may be mounted on a circular substrate and this substrate may be received in a cylindrical module.

Although the circuit configuration of the first power supply unit 7 serving as control power supply has not been described, circuit of the control power supply circuit can be made by a well known technique. For example, if the voltage conversion unit 8 includes an inductor, power fed from a second coil of the inductor can serve as the control power supply.

Figure 9:
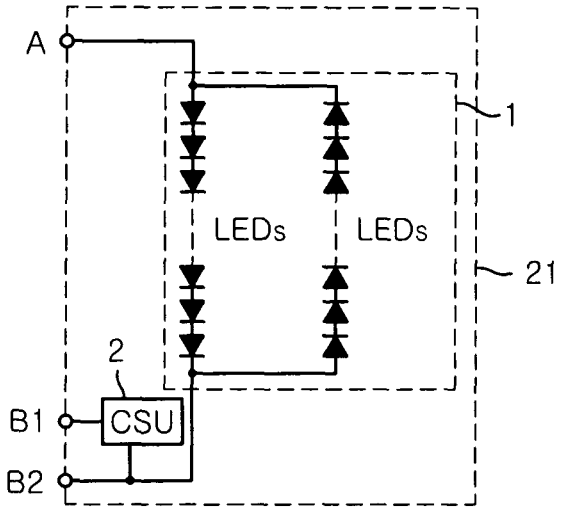
FIG. 9 is a circuit diagram of a modified example of the LED module in accordance with the first example of the first preferred embodiment of the present invention.

As shown in FIG. 9, the light source unit 1 of the LED module 21 may be constituted by two series circuits connected in anti-parallel, each series circuit having LEDs connected in series. In this case, the light source unit 1 is turned on if current is supplied to either the connecting terminal A or the connecting terminal B2. In the configuration of FIG. 9, the voltage conversion unit 8 may supply current to the LED module 21 by using an inverter circuit which is generally used in a lighting apparatus for a fluorescent lamp.

Example 2

Figure 10:
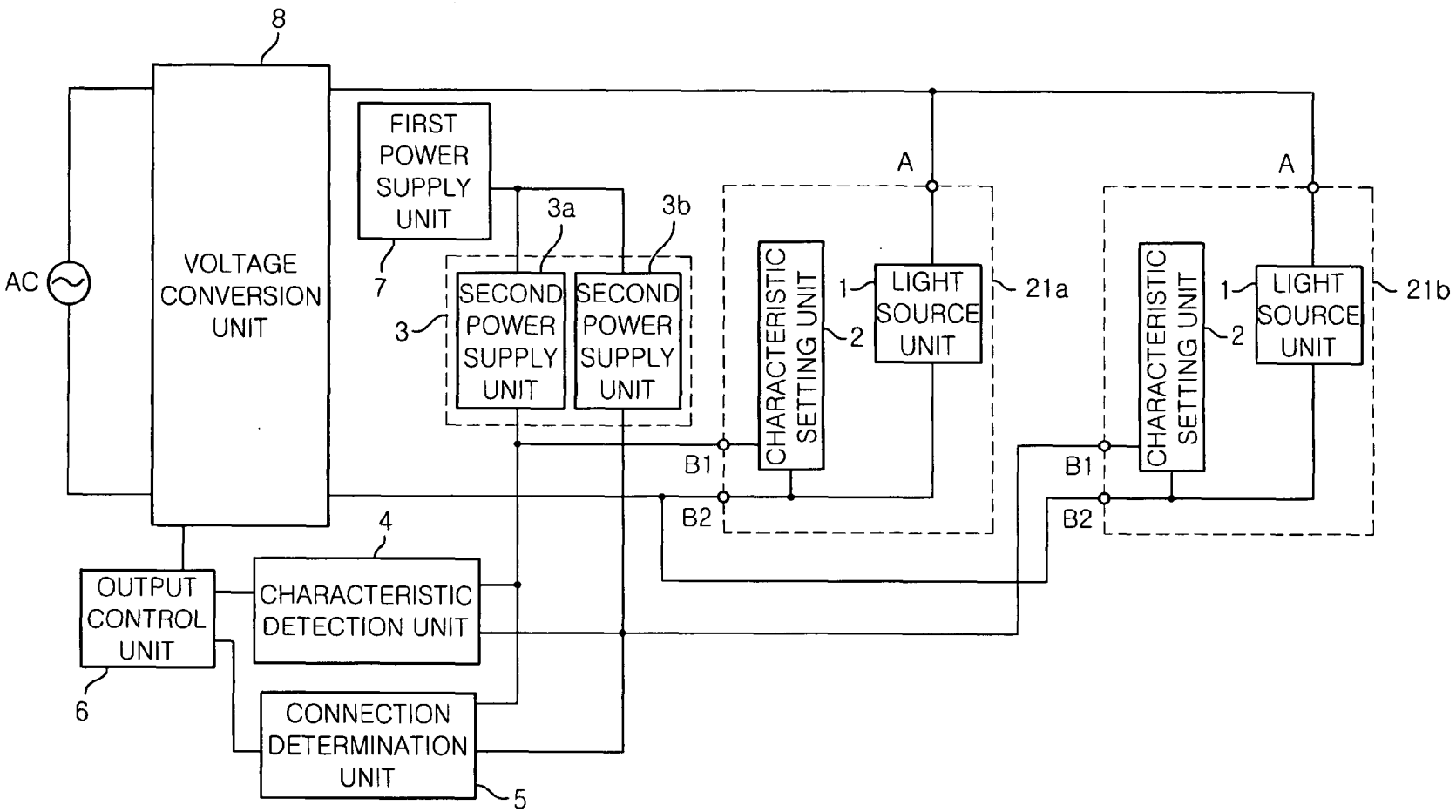
FIG. 10 represents a circuit diagram of a lighting apparatus in accordance with a second example of the first preferred embodiment of the present invention.

FIG. 10 illustrates a configuration of a lighting apparatus in accordance with Example 2. The lighting apparatus in this example is prepared to turn on two LED modules 21*a* and 21*b* connected in parallel, each LED module being the same as that in Example 1.

A second power supply unit 3 of the lighting apparatus includes second power supply units 3*a* and 3*b* for supplying power to the LED modules 21*a* and 21*b*, respectively. Each second power supply unit 3*a* or 3*b* is preferably formed of a constant current source as described above in Example 1.

A characteristic detection unit 4 may be constituted by a microcomputer as described in Example 1 and thus the basic operation is the same. It can use any configuration if information of the LED modules 21*a* and 21*b* can be detected by using a voltage waveform at a connecting terminal B1 of the LED module 21*a* and a voltage waveform at the connecting terminal B1 of the LED module 21*b*.

If multiple LED modules such as the LED modules 21*a* and 21*b* are connected as in this example, users might mistakenly connect LED modules having electrical characteristics different between each other. In order to determine if there is a wrong connection, the characteristic detection unit 4 determines if two informations inputted from the connecting terminals B1 of the LED modules 21*a* and 21*b* are identical to each other. If they are identical, the characteristic detection unit 4 sends an operation signal to the output control unit 6 to adjust to the set current based on the information. If not, the characteristic detection unit 4 is controlled to perform a more stable operation as will be described later.

The operation of a connection determination unit 5 may be basically the same as that in Example 1. That is, the connection determination unit 5 detects a voltage of the connecting terminal B1 and determines whether or not the LED module is connected by comparing the voltage of the connecting terminal B1 with a reference value. In this example where the two LED modules 21*a* and 21*b* are connected in parallel, a stop signal is sent to the output control unit 6 only if both the LED modules 21*a* and 21*b* are determined not to be connected.

It will now be described on operation when the users mistakenly connect LED modules with different electrical characteristics. For example, if an LED module 21*a* includes LEDs connected in series, each with electrical characteristics: 0.3 A and 3.5 V, and an LED module 21*b* includes 40 LEDs connected in series, each with electrical characteristics: 0.25 A and 3.5 V, the characteristic detection unit 4 determines that LED modules with different electrical characteristics are connected based on the two different informations inputted from the LED modules 21*a* and 21*b*.

Then, the characteristic detection unit 4 prioritizes the information of the LED module 21*b* having a lower characteristic current and outputs an operation signal for controlling the output control unit 6 to supply a current of 0.25 A from the voltage conversion unit 8. Alternatively, the characteristic detection unit 4 may output a stop signal for preventing the output control unit 6 from generating a driving signal, resulting in no current supplied to the LED modules.

If the voltage conversion unit 8 supplies the current of 0.25 A, the actual current flowing through the LED module 21*b* is smaller than 0.25 A, because the current is divided to flow to the LED module 21*a* as well as the LED module 21*b*.

In this example, the same effect as in Example 1 can be achieved and furthermore multiple LED modules can be turned on at once. Besides, when different types of LED modules are connected, the voltage conversion unit 8 is controlled to supply a current based on the set current of the LED module having a lower characteristic current or to stop supplying current. Accordingly, even when different types of LED modules remain connected by mistake, there does not occur broken-down or lifetime reduction of the LED module.

Example 3

Figure 11:
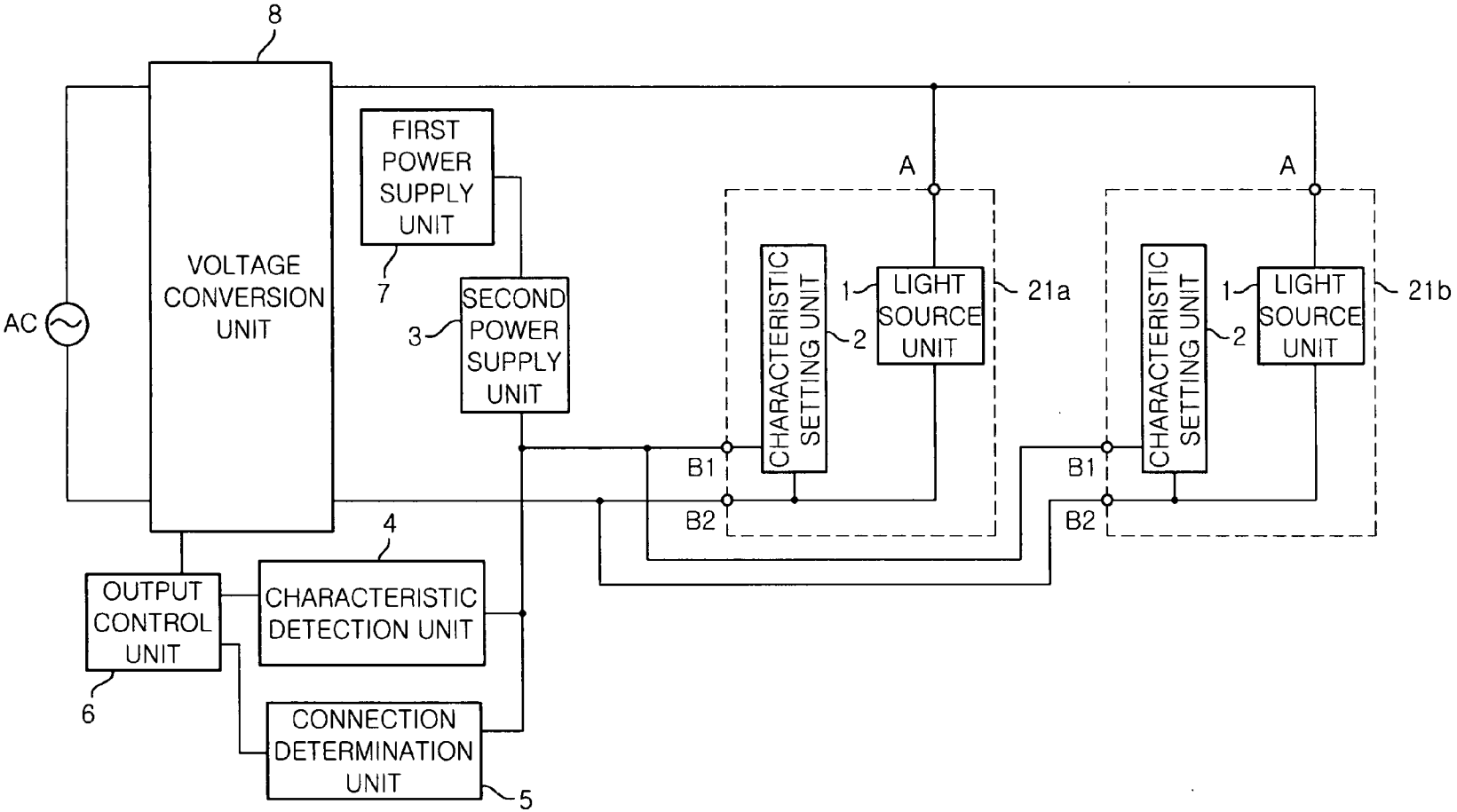
FIG. 11 presents a circuit diagram of a lighting apparatus in accordance with a third example of the first preferred embodiment of the present invention.

FIG. 11 shows a configuration of a lighting apparatus in accordance with Example 3. The lighting apparatus in this example is also prepared to turn on two LED modules connected in parallel. The two LED modules 21*a* and 21*b* have the same configuration as that in Examples 1 and 2 except for the detailed configuration of a characteristic setting unit 2 shown in FIG. 12.

Figure 12:
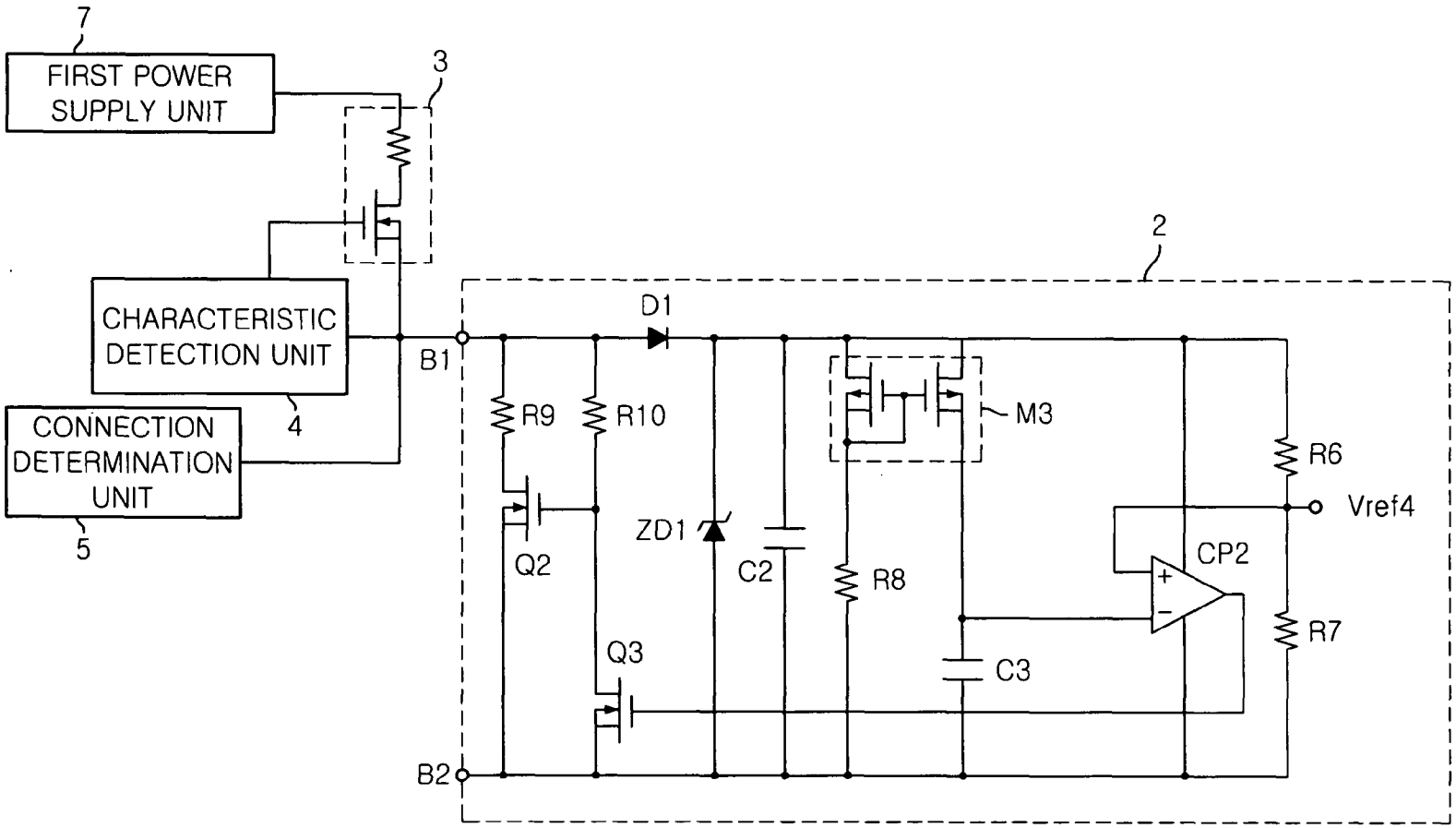
FIG. 12 describes a circuit diagram showing a detailed configuration of a characteristic setting unit in accordance with the third example of the first preferred embodiment of the present invention.

In the lighting apparatus of FIG. 11, a single second power supply unit 3 supplies control power to each characteristic setting unit 2 of the LED modules 21*a* and 21*b* unlike in Example 2. The second power supply unit 3 in this example includes a resistor and a switching element as shown in FIG. 12. The switching element of the second power supply unit 3 is turned on and off responding to a timing signal outputted from a characteristic detection unit 4 as shown in (a) of FIG. 13.

The characteristic setting unit 2 has connecting terminals B1 and B2 between which control power is applied from the second power supply unit 3. The control power is inputted to a parallel circuit of a Zener diode ZD1 and a capacitor C2 via a diode D1. Further, the control power is clamped to the Zener voltage Vz1 of the Zener diode ZD1 and at the same time smoothed by the capacitor C2. The resistor of the second power supply unit 3 limits the Zener current flowing through the Zener diode ZD1 to a predetermined value.

The control power is supplied from the second power supply unit 3, clamped by Zener voltage Vz1 and then applied to a mirror circuit M3, a comparator CP2 and a series circuit of resistors R6 and R7. The reference voltage Vref4 is obtained by dividing the Zener voltage Vz1 by a voltage divider circuit formed of the resistors R6 and R7 connected in series. The reference voltage Vref4 is applied to the positive input terminal of the comparator CP2.

The mirror circuit M3 supplies current to a capacitor C3, the current being determined by a resistor R8. That is, current flows into the mirror circuit M3 and the resistor R8 based on the voltage Vz1 of the capacitor C2, and current in proportion to the current flowing in the resistor R8 flows through the capacitor C3. The voltage between two ends of the capacitor C3 is applied to the negative input terminal of the comparator CP2 and compared to the reference voltage Vref4. The output of the comparator CP2 is applied into the gate of a switching element Q3 and a switching element Q2 is turned on or off by turning the switching element Q3 on or off.

Figure 13:
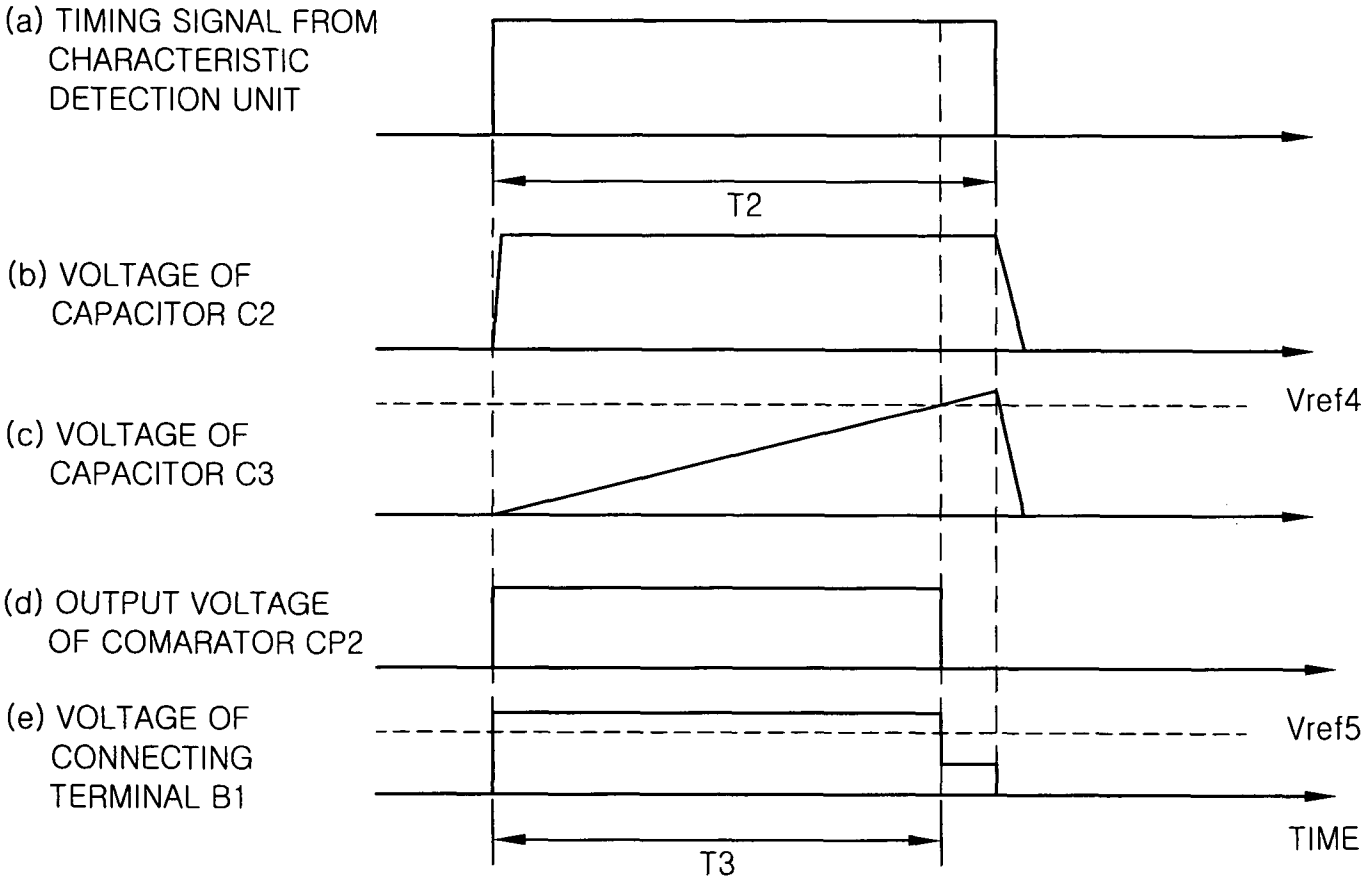
FIG. 13 offers a waveform chart for illustrating the operation of the characteristic setting unit in accordance with the third example of the first preferred embodiment of the present invention.

FIG. 13 shows a timing chart for describing operation of the characteristic setting unit 2. The operation will be described in detail with reference to FIG. 13.

The output voltage of the second power supply unit 3 is determined by a timing signal outputted from the characteristic detection unit 4 as shown in (a) of FIG. 13. During T2, the timing signal is at an H level and power is supplied from the second power supply unit 3 to the characteristic setting unit 2. The voltage of the capacitor C2 in the characteristic setting unit 2 has a waveform shown in (b) of FIG. 13 according to the output voltage of the second power supply unit 3. The voltage across the capacitor C3 linearly increases as shown in (c) of FIG. 13 by the current supplied from the mirror circuit M3.

By the comparator CP2, the voltage of the capacitor C3 is compared to the reference voltage Vref4, the output voltage of the comparator CP2 is at an H level during T3 when the voltage of the capacitor C3 is greater than the reference voltage Vref4, as shown in FIG. 13D. When the output voltage of the comparator CP2 becomes an L level after T3, the switching element Q3 is turned off and, accordingly, the switching element Q2 is turned on. Since the drain of the switching element Q2 is connected to the connecting terminal B1 via the resistor R9, the voltage of the connecting terminal B1 when the switching element Q2 is on is determined by dividing the voltage supplied from the first power supply unit 7 by resistive ratio of the resistor of the second power supply unit 3 and the resistor R9.

The characteristic detection unit 4 detects characteristic information by a time period where the voltage of the connecting terminal B1 is greater than a reference voltage Vref5 when the switching element Q2 is turned on. As shown in (e) of FIG. 13, the set current is determined based on the time period where the voltage of the connecting terminal B1 is higher than the reference voltage Vref5. Information on characteristics of LED is set by adjusting the resistive values of the resistors R6 and R7 included in the characteristic setting unit 2 to change the reference voltage Vref4 and thereby controlling the time period T3 where the voltage of the connecting terminal B1 is higher than the reference voltage Vref5.

Here, it is considered that an LED module 21*a* having T3 where the voltage of the connecting terminal B1 is higher than the reference voltage Vref5 and an LED module 21*b* having T3' shorter than T3 are connected. The capacitor C3 of each characteristic setting unit 2 of the LED modules 21*a* and 21*b* is charged based on the timing signal fed to the second power supply unit 3 from the characteristic detection unit 4. However, as described above, the voltage of the connecting terminal B1 decreases based on time period T3' set in the LED module 21*b*.

That is, the characteristic detection unit 4 detects characteristic information by prioritizing the LED module 21*b* having a lower characteristic current, i.e., a shorter time period T3'. Accordingly, the characteristic detection unit 4 sends an operation signal to the output control unit 6 so that the supply current from the voltage conversion unit 8 can be set based on the information of the LED module 21*b*.

Meanwhile, the connection determination unit 5 may operate like that in Example 1. Normally, because a voltage of the connecting terminal B1 is higher when the LED modules 21*a* and 21*b* are not connected than when the LED modules 21*a* and 21*b* are connected, the connection determination unit 5 may determine by detecting the voltage of the connecting terminal B1.

With this example, the same effects as in Examples 1 and 2 can be obtained. Further, since only a single wire is used to supply power from the second power supply unit 3 to each connecting terminal B1 of the multiple LED modules 21*a* and 21*b*, wiring can be reduced compared to Example 2. Furthermore, the circuit configuration of the characteristic setting unit 2 can be simplified.

Example 4

Figure 14:
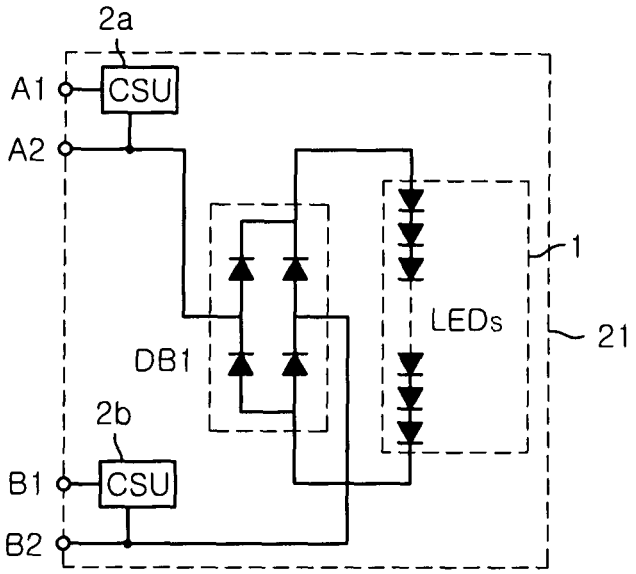
FIG. 14 is a circuit diagram of an LED module in accordance with a fourth example of the first preferred embodiment of the present invention.

FIG. 14 is a circuit diagram of an LED module 21 in accordance with Example 4. As shown in FIG. 14, a voltage applied between a connecting terminal A2 and a connecting terminal B2 is rectified by a rectifier DB1. The positive output terminal of the rectifier DB1 is coupled to the positive terminal of a light source unit 1, whereas the negative output terminal of the rectifier DB1 is coupled to the negative connecting terminal of the light source unit 1. A characteristic setting unit 2*a* is disposed between the connecting terminals A1 and A2, whereas a characteristic setting unit 2*b* is disposed between the connecting terminals B1 and B2.

Figure 15:
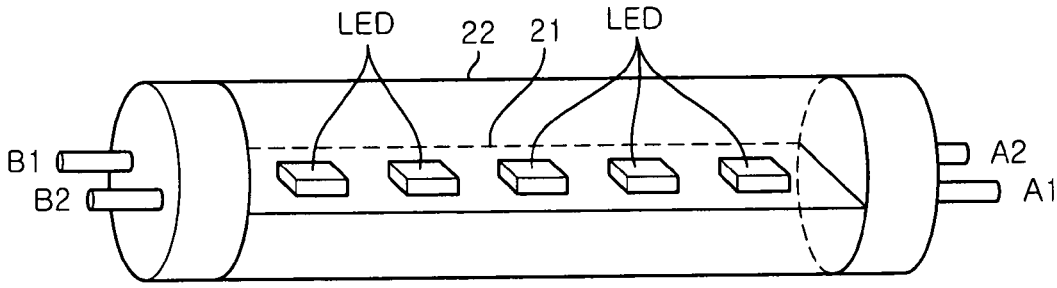
FIG. 15 shows a perspective view illustrating a brief configuration of the LED module in accordance with the fourth example of the first preferred embodiment of the present invention.

FIG. 15 shows an exemplified configuration of the LED module 21. As shown in FIG. 15, one or more substrate having multiple LEDs forming the light source unit 1 mounted thereon are received in a light-transmitting housing 22 like in Example 1. The connecting terminals A1 and A2 are located at one end of the housing 22, and the connecting terminals B1 and B2 are located to diagonally face the connecting terminals A1 and A2 at the other end.

Although the specific circuit configurations of the characteristic setting units 2*a* and 2*b* are not illustrated, the configuration described in Example 1 or 3 may be employed. The two characteristic setting units 2*a* and 2*b* are set to have the same characteristic information, i.e., circuit constant, and are mounted on the same substrate as that where the light source units 1 is mounted. More specifically, the characteristic setting unit 2*a* is disposed close to the connecting terminals A1 and A2, whereas the characteristic setting unit 2*b* is disposed close to the connecting terminals B1 and B2.

One of the illuminating devices described in Examples 1 to 3 can be used to supply current to the LED module 21 in this example. However, unlike Examples 1 to 3 where the current is supplied to the connecting terminal A of the LED module 21, the current is supplied to the connecting terminal A2 or the connecting terminal B2 of the LED module 21 in this example.

Figure 16:
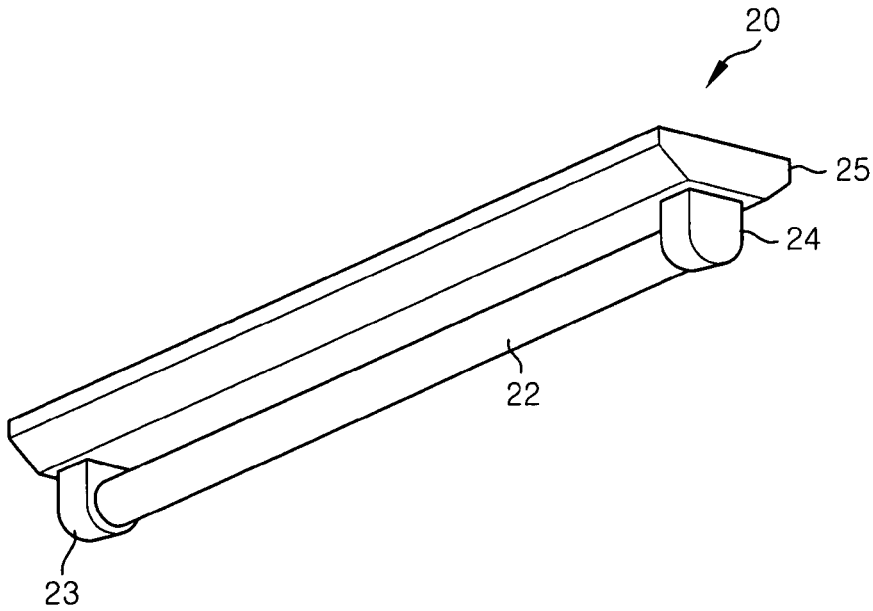
FIG. 16 is a perspective view illustrating an illumination apparatus with the LED module of the fourth example of the first preferred embodiment of the present invention.

FIG. 16 illustrates an example of an illumination apparatus 20 which an LED module 21 can be connected to. The above-described illuminating devices are provided in a main body 25 of the illumination apparatus shown in FIG. 16. The lighting apparatus and the LED module 21 are electrically connected via sockets 23 and 24. For example, the connecting terminals A1 and A2 are inserted into the socket 23, and the connecting terminals B1 and B2 are inserted into the socket 24. When current is supplied to the LED module 21 from the lighting apparatus and flows in through the connecting terminal A2, for example, the characteristic setting unit 2*b* provided at a side of the connecting terminals B1 and B2 is connected to the lighting apparatus and detects information of the LED module 21.

Although the connecting terminals A1 and A2 and the connecting terminals B1 and B2 are disposed as shown in FIG. 15, it is considerable that a user mistakenly connects the connecting terminals A1 and A2 and the connecting terminals B1 and B2 of the LED module in reverse to the illuminating device. In this case, current supplied to the LED module 21 from the lighting apparatus flows in through the connecting terminal B2, and the characteristic setting unit 2*a* disposed at a side of the connecting terminals A1 and A2 is connected to the lighting apparatus and detects information of the LED module 21.

As described above, the same effect as in Example 1 can be obtained in this example. Furthermore, the connecting terminals, e.g., A2 and B2 for supplying current to the light source unit of the LED module and the connecting terminals, e.g., A1 and B1 for detecting information of the LED module are arranged to diagonally face when viewed on plane coplanar or parallel to the substrate surface of the LED module as described above in this example. Therefore, when the LED module is connected to the illumination apparatus, the connection of the light emitting diodes with the wrong polarity or the wrong connection between the power supply line and the signal supply line does not occur. Further, a user can easily remove the LED module from the illumination apparatus or reinstall it.

Example 5

Figure 17:
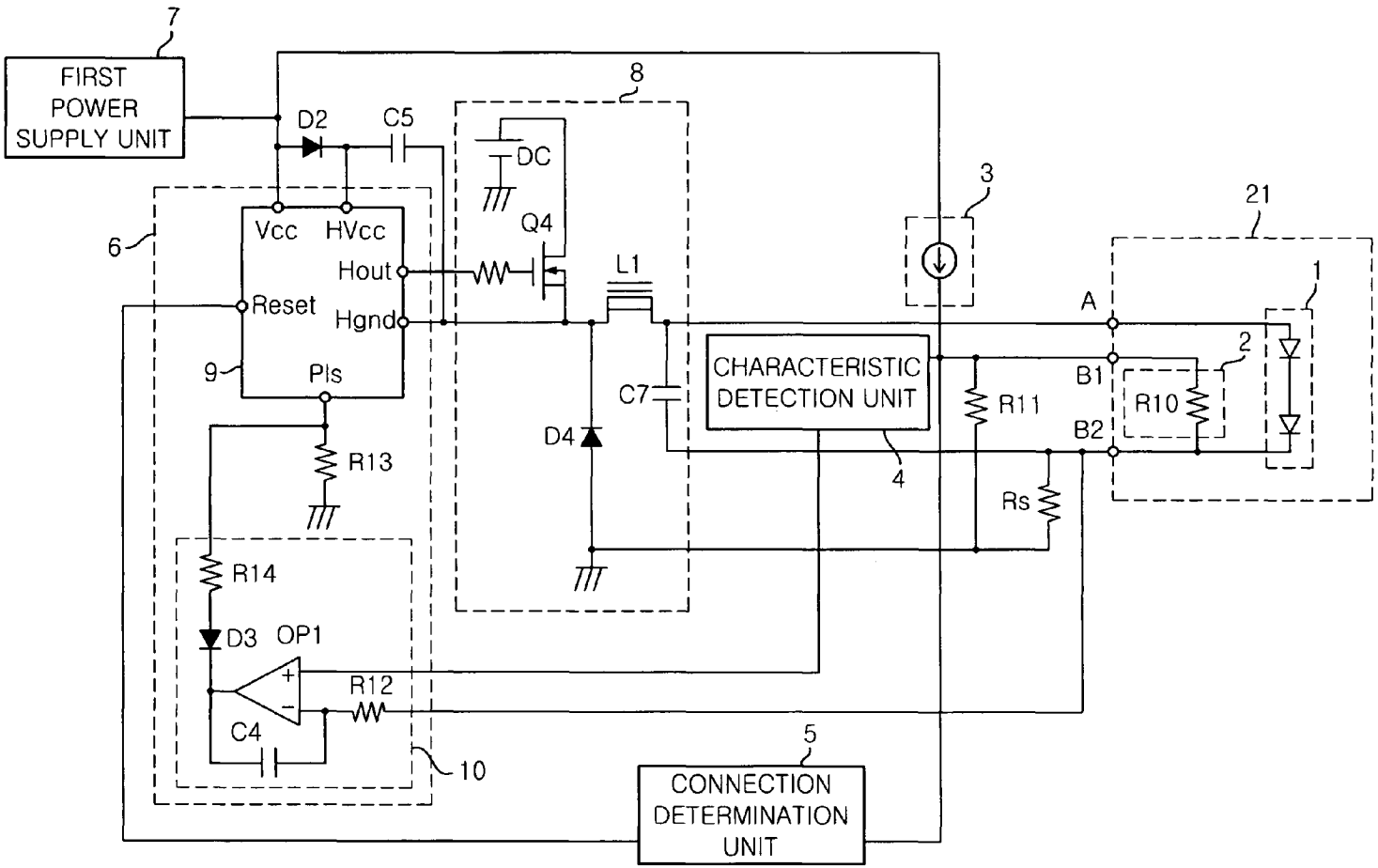
FIG. 17 shows a circuit diagram of a lighting apparatus in accordance with a fifth example of the first preferred embodiment of the present invention.

FIG. 17 is a circuit diagram of a lighting apparatus in accordance with Example 5. A voltage conversion unit 8 may be constituted by a well-known voltage reduction chopper circuit. The voltage conversion unit 8 has a direct-current power supply DC obtained by rectifying and smoothing alternating-current power or by raising direct-current power with a voltage boosting chopper circuit. The voltage conversion unit 8 further includes a switching element Q4 whose drain is coupled to the positive output terminal of the direct-current power supply DC; an inductor L1 whose one is coupled to a source of the switching element Q4 and the other end connected to a connecting terminal A of an LED module 21; a diode D4 connected to a connection point between the source of the switching element Q4 and the inductor L1; and a smoothing capacitor C7 connected to the other end of the inductor L1.

The on/off operation of the switching element Q4 is controlled by a driving signal outputted from a terminal Hout of a driver circuit 9 included in an output control unit 6. When the switching element Q4 is turned on, current flows through the inductor L1 and thereby electromagnetic energy is stored in the inductor L1. When the switching element Q4 is turned off, the electromagnetic energy stored in the inductor L1 is discharged through a diode D4 connected between the source of the switching element Q4 and the ground.

The basic configuration of the LED module 21 is the same as that in Example 1 except for a characteristic setting unit 2 constituted by a resistor R10. A second power supply unit 3 for supplying control power to the characteristic setting unit 2 is constituted by a constant current source as shown in FIG. 17. This constant current source supplies current to resistors R11 and R10. The resistor R11 in the lighting apparatus is connected between a connecting terminal B1 and the ground. Both the resistor R11 of the lighting apparatus and the resistor R10 of the characteristic setting unit 2 are connected to the connecting terminal B1.

A resistor Rs is located between a connecting terminal B2 and the ground of the illuminating device, the connecting terminal B2 being connected to a negative connecting terminal of a light source unit 1 included in the LED module 21. Current supplied from the connecting terminal A flows in through the light source unit 1 and flows out through the connecting terminal B2. Then, it flows to the ground via the resistor Rs. The smoothing capacitor C7 is connected to the resistor Rs and, accordingly, the smoothing capacitor C7 is charged and discharged by the current flowing through the resistor Rs. Therefore, the sum current of the current flowing through the LED module 21 and the current flowing through the reservoir capacitor C7 is detected through the resistor Rs.

The voltage across the resistor Rs is obtained by multiplying a resistive value of the resistor Rs to a current flowing through the resistor Rs, and is fed to a feedback operational circuit 10 of the output control unit 6. The feedback operational circuit 10 may be constituted by an operational amplifier OP1. The detected voltage is fed into the negative input terminal of the operational amplifier OP1 via a resistor R12. A capacitor C4 is coupled between the negative input terminal and the output terminal of the operational amplifier OP1, which forms a well-known integrator circuit.

On the other hand, a setting signal from the characteristic detection unit 4 is fed to the positive input terminal of the operational amplifier OP1, the setting signal being based on information set of the LED module 21. Then, the setting signal and the detected signal are integrated and the integrated result is outputted from the output terminal of the operational amplifier OP1. The output terminal of the operational amplifier OP1 is connected to a terminal Pls of the driver circuit 9 via a diode D3 and a resistor R14. The terminal Pls is a terminal for controlling an ON-pulse width of the switching element Q4 driven by the driver circuit 9.

Next, operation of the terminal Pls of the driver circuit 9 will be briefly described. In the driver circuit 9, connected to the terminal Pls is a constant voltage buffer circuit, a mirror circuit and a driving signal setting capacitor. Specifically, a resistor R13 is connected between the ground and the terminal Pls serving as an output terminal of the constant voltage buffer circuit. Current flowing through the resistor R13 is mirrored by the mirror circuit and thereby the driving signal setting capacitor is charged and discharged, as is well known.

Figure 18:
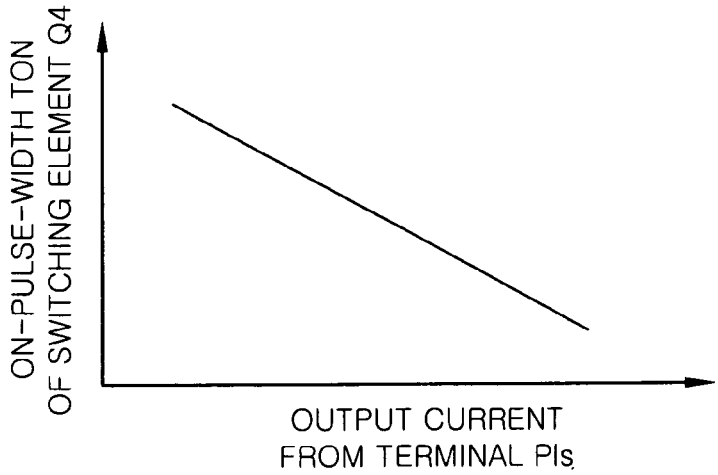
FIG. 18 provides a characteristic curve for describing the operation of the lighting apparatus in accordance with the fifth example of the first preferred embodiment of the present invention.

If the time period until the driving signal setting capacitor is charged to a predetermined level is set to be the same as a time period Ton where the driving signal fed to the switching element Q4 is at an H level, the relation between current Ipls flowing through the resistor R13 from the terminal Pls and the time period Ton can be represented as shown in FIG. 18. That is, as the current Ipls flowing through the resistor Rs from the terminal Pls increases, the time period Ton decreases.

Here, the operation of the feedback operational circuit 10 will be described again. For example, if the current flowing through the inductor L1 increases, the level of the signal detected from the resistor Rs increases. At this point, the output voltage of the operational amplifier OP1 of the feedback amplifier circuit 10 is reduced, and the current drawn by the operational amplifier OP1 from the terminal Pls increases. Because of this, the current Ipls flowing out through the terminal Pls increases. As the current Ipls flowing out through the terminal Pls increases, the driver circuit 9 is controlled to decrease the time period Ton where the driving signal outputted from the terminal Hout is at an H level and to suppress an increase of the current flowing through the inductor L1, i.e., to reduce the current supplied to the LED module 21.

In the driver circuit 9, control power for control circuits used to feed the driving signal to the switching element Q4 from the terminal Hout can be obtained by charging a capacitor C5 via a diode D2. Since this can be easily implemented by a half bridge driver circuit generally used as an inverter circuit for fluorescent lamps, detailed description thereof will be omitted.

Next, the operations of the characteristic setting unit 2, the characteristic detection unit 4 and the connection determination unit 5 in this example will be described.

For example, if the resistor Rs has a resistive value less than a few ohms and the resistor R10 of the characteristic setting unit 2 included in the LED module 21 has a resistive value more than several tens kilo-ohms, a value of the resistor Rs can fall within an error range of the resistor R10.

Figure 19:
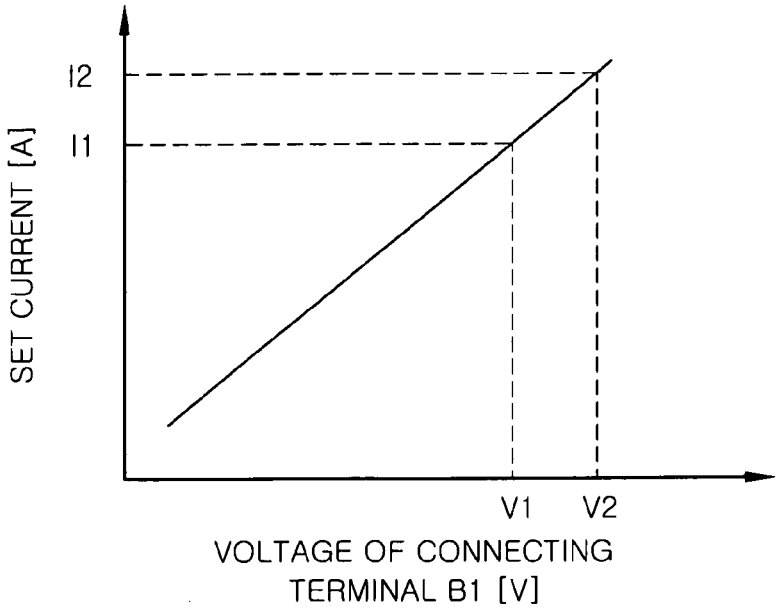
FIG. 19 illustrates a characteristic curve illustrating the relationship between characteristic setting information and set current in accordance with the fifth example of the first preferred embodiment of the present invention.

When the LED module 21 is connected to the lighting apparatus but the switching element Q4 is not operating, a voltage of the connecting terminal B1 is determined by the current supplied to the resistor R10 from the second power supply unit 3 and the resistive value of the resistor R10. The set current is determined by this voltage based on relationship as shown in FIG. 19.

Next, description will be made on a case where the LED module 21 is connected to the lighting apparatus and the switching element Q4 is operating. For example, if a current of 0.35 A is supplied to the LED module 21, a peak current flowing through the inductor L1 is about 0.70 A. The voltage across the resistor Rs having a resistive value of, e.g., 1 ohm varies in the range from 0 V to 0.7 V. Thus, the voltage of the connecting terminal B1 varies depending on the switching operation.

Accordingly, in order to prevent misreading characteristic information of the LED module 21, the information detection operation of the characteristic detection unit 4 is not performed while the switching element Q4 is operating.

When the LED module 21 is not connected, the resistor R10 in the LED module 21 is disconnected and thus all the constant current outputted from the second power supply unit 3 flows through the resistor R11 of the illuminating device, resulting in an increase of the voltage of the resistor R11. The connection determination unit 5 compares the voltage of the connecting terminal B1 with a reference voltage Vref6 and determines the connection/non-connection of the LED module 21 as described in Example 1. When the connection determination unit 5 determines that the LED module 21 is removed, it outputs a stop signal to a terminal Reset of the driver circuit 9. Upon receiving the stop signal at the terminal Reset, the driver circuit 9 stops generating a driving signal.

Next, description will be made on the operation sequence after the direct-current power DC is supplied and control power is outputted by the control power supply unit 7 with reference to FIG. 20.

Figure 20:
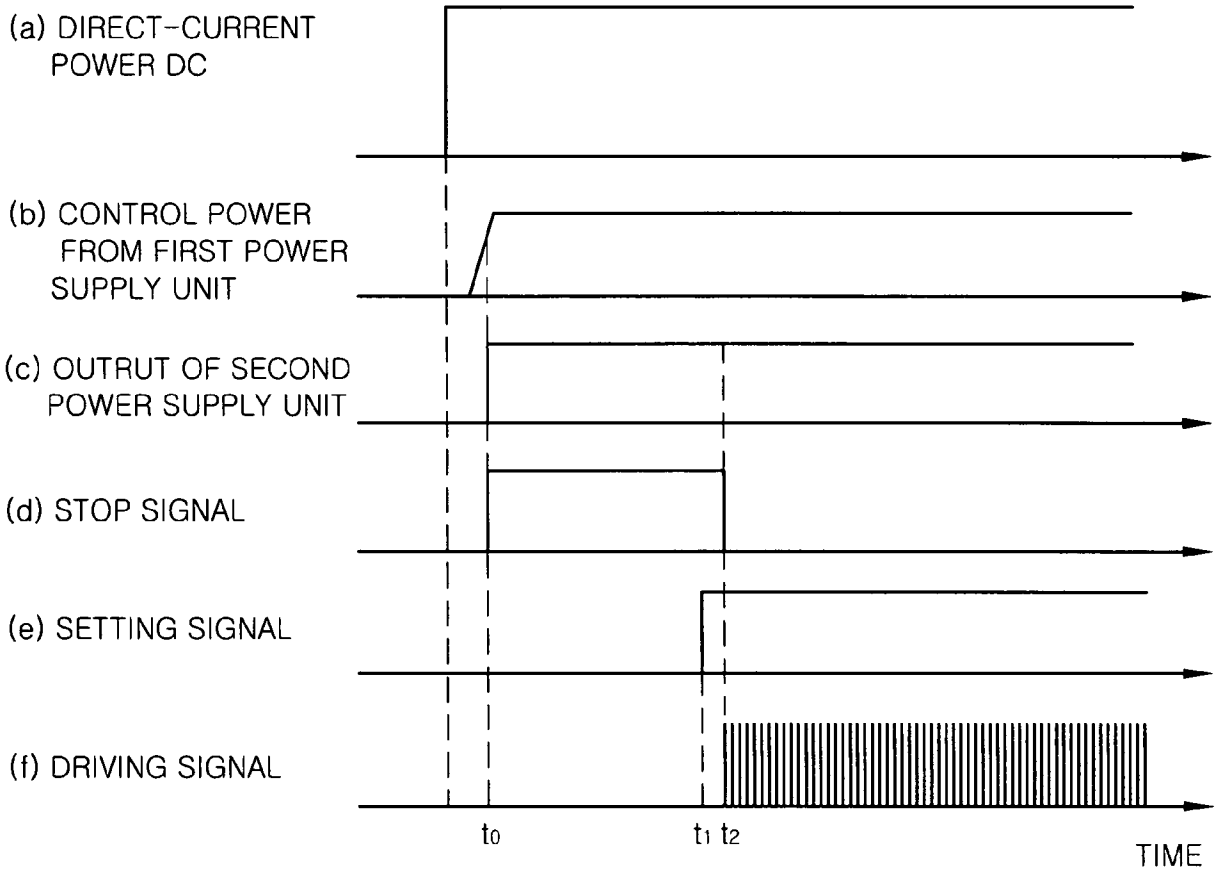
FIG. 20 provides a waveform chart for illustrating the operation of each unit when the operation starts in accordance with the fifth example of the first preferred embodiment of the present invention.

When the direct-current power supply DC is supplied as shown in (a) of FIG. 20, the first power supply unit 7 starts supplying control power as shown in (b) of FIG. 20. At time t0, when the voltage of the control power reaches a predetermined voltage level, the second power supply unit 3 starts supplying control power by constant current as shown in (c) of FIG. 20. The characteristic detection unit 4 and the connection determination unit 5 also start operating at t0.

Regardless of the connection of the LED module 21, the connection determination unit 5 provided with a timer unit outputs a stop signal to the terminal Reset to prevent the driver circuit 9 from supplying a driving signal until a predetermined time t2 as shown in (d) of FIG. 20.

Meanwhile, the characteristic detection unit 4 detects the characteristic information preset in the characteristic setting unit 2 until the time point t1 and then outputs a setting signal corresponding to a set current to the feedback operational circuit 10 as shown in (e) of FIG. 20.

When the LED module 21 is connected at t2, the connection determination unit 5 clears the stop signal and, accordingly, the driver circuit 9 outputs a driving signal for the switching element Q4 as shown in (f) of FIG. 20.

On the other hand, when the LED module 21 is not connected at t2, the connection determination unit 5 does not count any longer and keeps a state at t0 until the LED module 21 is connected. In the meantime, the characteristic detection unit 4 repeats detection of the characteristic information.

The LED module and the lighting apparatus as described in this example can be also installed in the illumination apparatus shown in FIG. 16 as described in Example 4. When they are installed in the illumination apparatus, the lighting apparatus can be wrongly connected to the sockets in electrical wiring. In particular, it is considered the connecting terminals B1 and B2 are reversely connected. Since the characteristic setting unit 2 in this example is constituted by the resistor R10, the current flowing through the light source unit 1 flows to the resistor Rs and the ground via the characteristic setting unit 2.

Furthermore, the characteristic detection unit 4 detects the information of the LED module 21 and the output control unit 6 outputs the driving signal based on the detected information. However, since the voltage of the connecting, terminal B1 increases, the connection determination unit 5 detects the voltage of the connecting terminal B1 higher than the predetermined reference voltage Vref6 and outputs the stop signal to the output control unit 6. Thus, when the connecting terminals B1 and B2 is reversely connected, a power supply to the LED module 21 can be safely stopped by the connection determination unit 5.

For example, the connection determination unit 5 may compare the voltage of the connecting terminal B1 with reference voltage Vref7 lower than the reference voltage Vref6 and continue to output a stop signal to the terminal Reset of the driver circuit while the voltage of the connecting terminal B1 is lower than the reference voltage Vref7. With this configuration, even when the characteristic setting unit 2 of the LED module 21 or wiring for connecting the connecting terminals B1 and B2 to the lighting apparatus is short-circuited for any reason, the lighting apparatus can remain stopped by the stop signal from the connection determination unit 5. Accordingly, the lighting apparatus and the LED module can be used more safely.

Although the driving signal is outputted from the output control unit 6 and then the characteristic detection unit 4 stops the characteristic detection operation in this example, the characteristic detection unit 4 may stop the characteristic detection operation based on the stop signal inputted to the terminal Reset from the connection determination unit 5. Alternatively, the characteristic detection unit 4 may stop the characteristic measurement operation based on the stop signal fed to the terminal Reset of the driver circuit 9 from the connection determination unit 5. Further, the second power supply unit 3 supplies power during the predetermined time right after control power has been outputted and the characteristic measurement operation may be performed during this time.

In this example, the same effects as in Examples 1 to 3 can be achieved. Furthermore, since a feedback control has been done by detecting the current supplied to the LED module, more stable current can be supplied to the LED module, thereby preventing over current from flowing to the LED module. Additionally, the operation of the lighting apparatus can be stopped when breakdown of electronic components or wiring error occurs, thereby significantly improving reliability.

By adapting to this example the basic circuit configuration of the LED module as described in Example 4, the same effect as in Example 4 can be achieved. Further, a user can easily remove the LED module from the illumination apparatus or reinstall it.

Example 6

Figure 21:
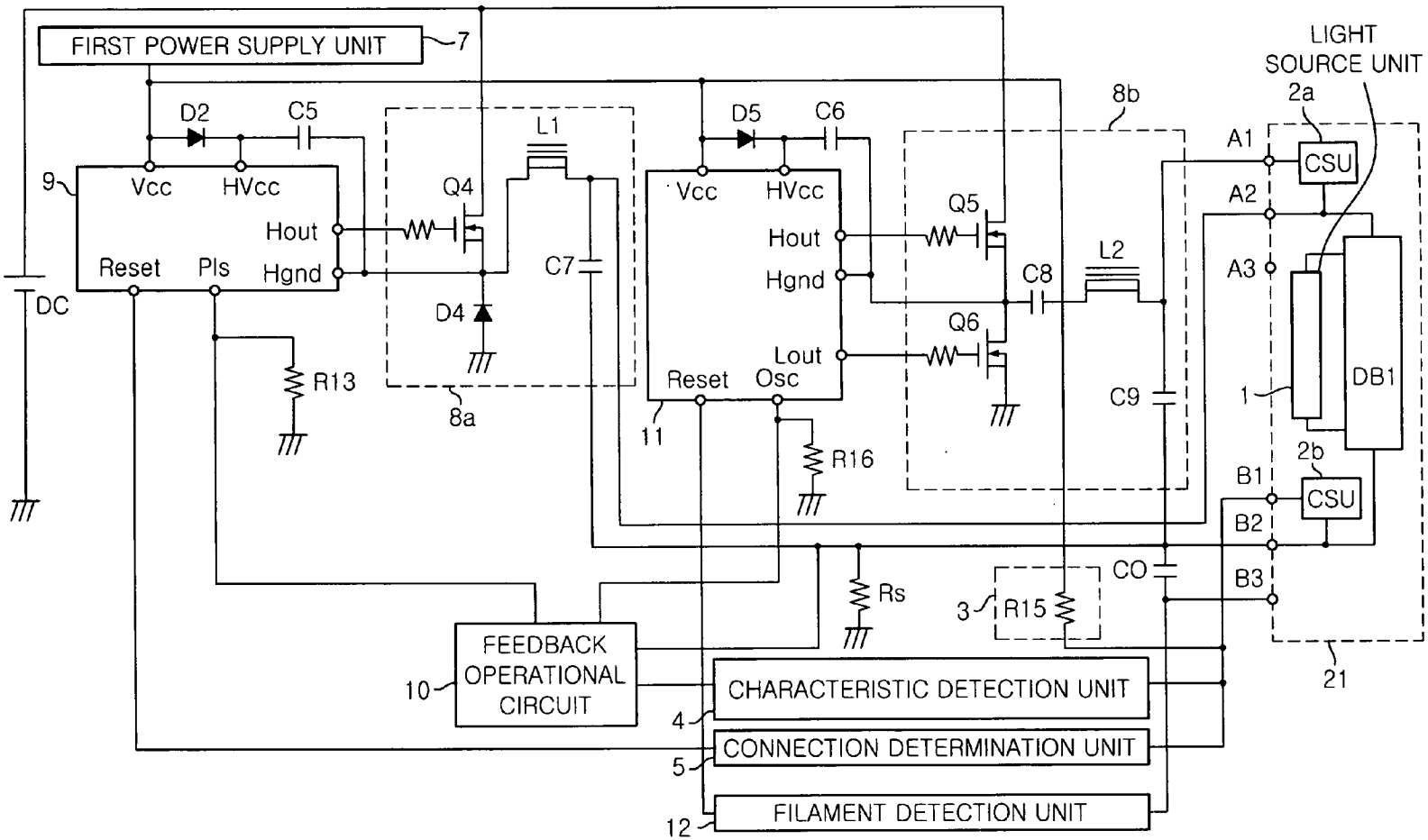
FIG. 21 represents a circuit diagram of a lighting apparatus in accordance with a sixth example of the first preferred embodiment of the present invention.
Figure 22:
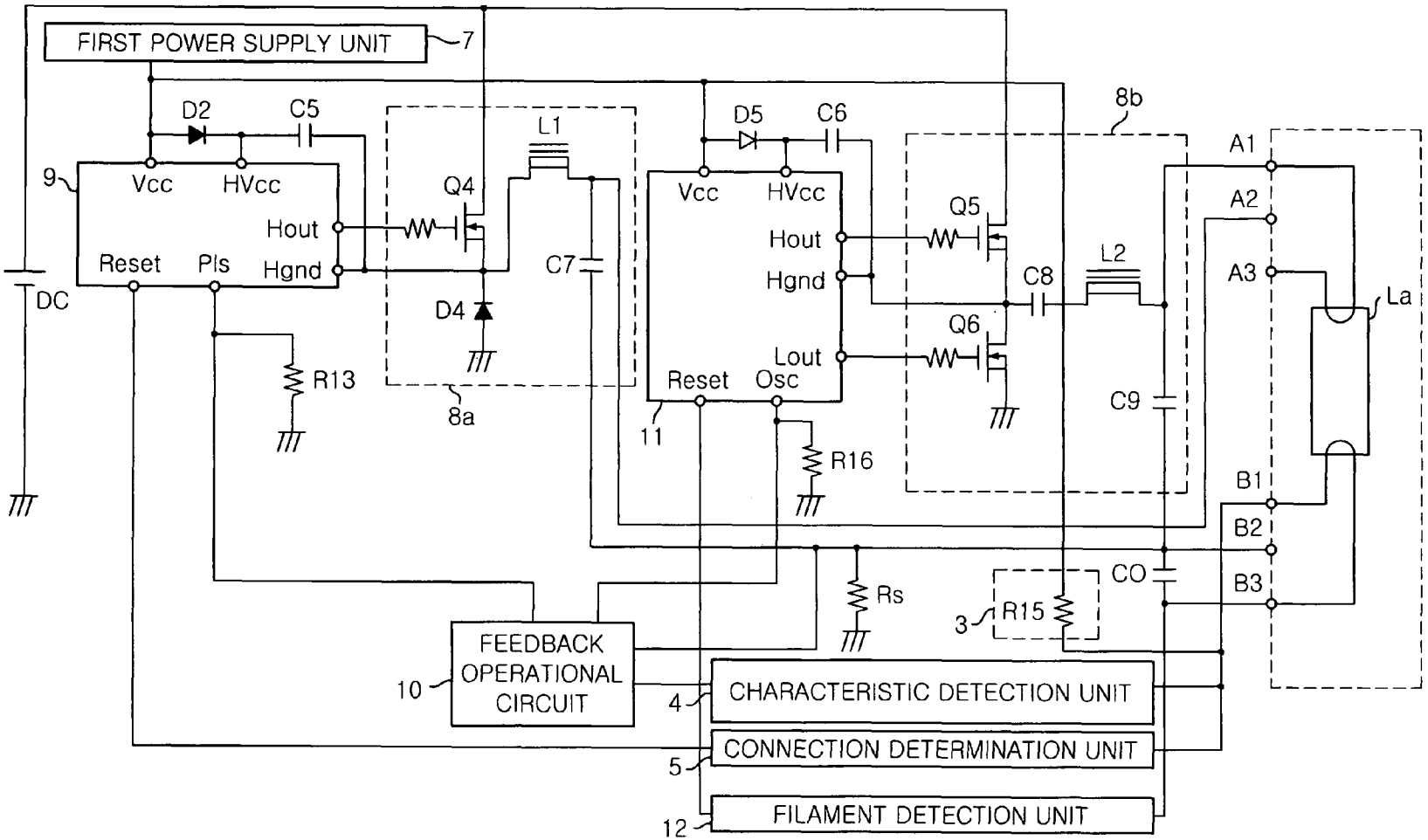
FIG. 22 is a circuit diagram of the lighting apparatus with a discharge lamp connected thereto in accordance with the sixth example of the first preferred embodiment of the present invention.

FIGS. 21 and 22 illustrate circuit diagrams of a lighting apparatus of Example 6. In this example, the lighting apparatus capable of turning on both direct-current driven light sources such as the LEDs described in Examples 1 to 5 and alternating-current driven fluorescent lamps will be described. FIG. 21 shows a basic configuration of the lighting apparatus with an LED module 21 connected thereto, and FIG. 22 presents a basic configuration of the lighting apparatus with a fluorescent lamp La connected thereto.

In FIG. 21, the configuration of the LED module 21 is basically the same as that described in Example 4 as shown in FIG. 14. The difference is that there are provided connecting terminals A1, A2 and A3, connecting terminals B1, B2 and B3, and characteristic setting units 2*a* and 2*b* having the same circuit and the same circuit constant, characteristic setting units 2*a* and 2*b* being located between the connecting terminals A1 and A2 and between the connecting terminals the B1 and B2, respectively. The characteristic setting units 2*a* and 2*b* in this example are constituted by a resistor as described in Example 5.

Figure 23:
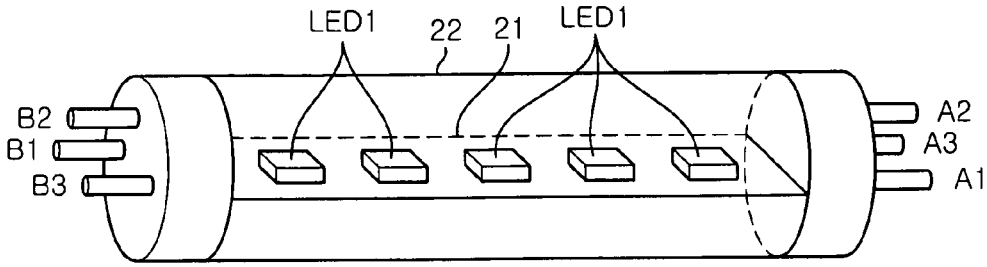
FIG. 23 shows a perspective view illustrating a brief configuration of an LED module in accordance with the sixth example of the first preferred embodiment of the present invention.

As shown in FIG. 23, the connecting terminals A1, A2 and A3 of the LED module 21 are located on one end of a light-transmitting housing 22, and connecting terminals B1, B2 and B3 are located on the other end of the housing 22. The connecting terminals A1, A2 and A3 and the connecting terminals B1, B2 and B3 are arranged to face each other. For example, the connecting terminals A1 and A3 are disposed to diagonally face the connecting terminals B1 and B3, and the connecting terminals A2 and B2 are disposed to face each other.

Figure 24:
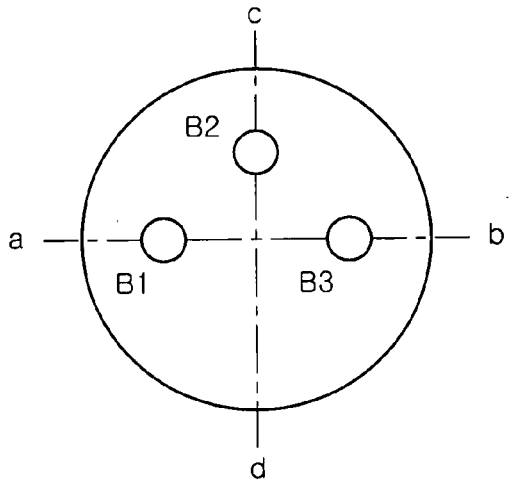
FIG. 24 is a front view seen from the lengthwise ends of the LED module in accordance with the sixth example of the first preferred embodiment of the present invention.

Further, the arrangement and the shape of the connecting terminals A1, A3 and the connecting terminals B1 and B3 may be the same as those in the conventional fluorescent lamps, and the connecting terminals A2 and B2 may be located at an arbitrary point on the dashed-dotted line c-d in FIG. 24.

If the LED module 21 is connected to the lighting apparatus as shown in FIG. 21, it is turned on by direct-current power outputted from a voltage conversion unit 8*a*. The voltage conversion unit 8*a* is constituted by a voltage reduction chopper circuit as in Example 5, wherein like reference numerals will be assigned to like parts having the same operations and redundant description thereof will be omitted.

In this example, there is provided a voltage conversion unit 8*b* for supplying high-frequency power to turn on the fluorescent lamp La when the fluorescent lamp La is connected thereto. The circuit operation of the voltage conversion unit 8*b* and an inverter driver circuit 11 for outputting a driving signal to the voltage conversion unit 8*b* will be described later.

An output control unit 6 includes a driver circuit 9, the inverter driver circuit 11 and a feedback operational circuit 10. A setting signal is inputted to the feedback operational circuit 10 from a characteristic detection unit 4, and changes a driving signal outputted from the driver circuit 9 or the inverter driver circuit 11 based on an output signal from the feedback operational circuit 10.

Unlike the other examples, a second power supply unit 3 is constituted by a resistor R15 and thus forms a voltage divider together with the characteristic setting unit 2*a* or 2*b* connected thereto, thereby supplying a voltage divided by the voltage divider.

The characteristic detection unit 4, like in Example 5, outputs a setting signal based on the divided voltage, and thus the feedback operational circuit 10 controls the driver circuit 9 based on the setting signal and a signal detected from a resistor Rs.

Figure 25:
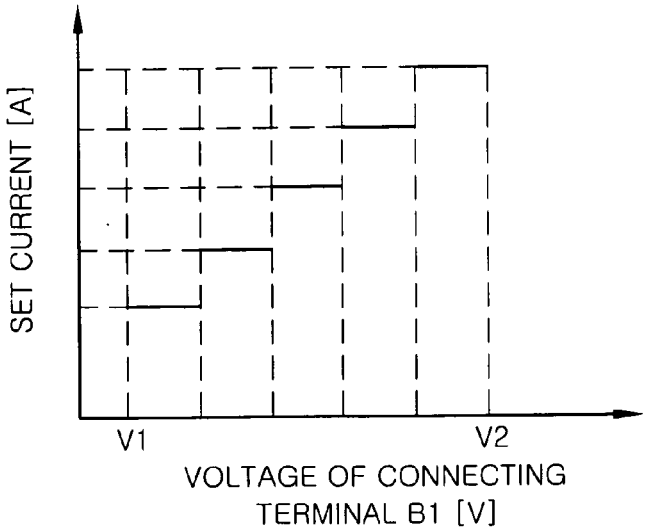
FIG. 25 illustrates a characteristic curve illustrating the relationship between characteristic setting information and set current in accordance with the sixth example of the first preferred embodiment of the present invention.

As shown in FIG. 25, the set current of the characteristic detection unit 4 increases in stepwise as the voltage of the connecting terminal B1 varies from V1 to V2.

If the LED module 21 is not connected, the voltage at the connecting terminal B1 increases. If the voltage is higher than the voltage V2 of FIG. 25, the connection determination unit 5 determines that the LED module 21 is disconnected like in Example 5. Then, the connection determination unit 5 sends a stop signal to the driver circuit 9 to stop the operation of the voltage conversion unit 8*a*. When the LED module 21 is connected, the connection determination unit 5 clears the stop signal inputted to the driver circuit 9 and resumes the operation of the voltage conversion unit 8*a*.

If the fluorescent lamp La is connected as shown in FIG. 22, a capacitor C0 is charged through the route from the second power supply unit 3, via the connecting terminal B1, a filament of the fluorescent lamp La, and the connecting terminal B3, to the capacitor C0. The voltage of the capacitor C0 is fed to a filament detection unit 12 and thereby the connection of the fluorescent lamp La is determined. If the filament detection unit 12 determines that the fluorescent lamp La is connected, it stops generating a stop signal to the terminal Reset of the inverter driver circuit 11, thereby resuming the operation of the inverter driver circuit 11 and the voltage conversion unit 8*b*.

As shown in FIG. 22, a high-frequency power is supplied to the capacitor C0 via the connecting terminal A1, the fluorescent lamp La and the connecting terminal B3 from the voltage conversion unit 8*b*.

The filament of the fluorescent lamp La is connected between the connecting terminals A1 and A3 and the connecting terminals B1 and B3. Preheating current is supplied to the filament from a preheating circuit (not shown) after the operation of the voltage conversion unit 8*b* is resumed.

The voltage conversion unit 8*b* includes a series circuit having two switching elements Q5 and Q6 connected in series which is connected to the output terminal of a direct-current power supply DC; and a resonant circuit mainly including a resonant inductor L2 and a resonant capacitor C9, the resonant circuit being connected in parallel to the switching element Q6. One end of the resonant capacitor C9 is coupled to the connecting terminal A1, and the other end of the resonant capacitor C9 is connected to the connecting terminal B3 via the capacitor C0.

The switching elements Q5 and Q6 are alternately turned on and off by driving signals from terminals Hout and Lout of the inverter driver circuit 11, respectively. The frequency of the driving signals outputted from the inverter driver circuit 11 is controlled by the current flowing out through a terminal Osc of the inverter driver circuit 11 into an operational amplifier of the feedback operational circuit 10 (see FIG. 17).

For example, the inverter driver circuit 11 includes a constant voltage buffer circuit, a mirror circuit and a driving signal setting capacitor connected to the terminal Osc, and a resistor R16 connected between the terminal Osc serving as the output terminal of the constant voltage buffer circuit and the ground. The inverter driver circuit 11 can charge or discharge the driving signal setting capacitor by converting current flowing through a resistor R16 by the mirror circuit. As the current flowing through the fluorescent lamp La increases, the level of the signal detected from the resistor Rs increases by the operation of the feedback operational circuit 10 as described above.

If the feedback operational circuit 10 is constituted by, e.g., that of Example 5 adapted to both of the alternating current and direct current, the output voltage of the operational amplifier OP1 of the feedback amplifier circuit 10 is reduced as the level of the detected signal increases. Thus, since the current drawn by the operational amplifier OP1 of the feedback operational circuit 10 from the terminal Osc of the inverter driver circuit 11 increases, current Iosc flowing out through the terminal Osc increases. As the current Iosc flowing out through the terminal Osc of the inverter driver circuit 11 increases, the inverter driver circuit 11 is controlled such that the frequency of the driving signals from terminals Lout and Hout increases, thereby suppressing an increase of the current flowing through the fluorescent lamp La.

In the inverter driver circuit 11, control power for control circuits used to feed the driving signal into the switching element Q5 at a high potential level through the terminal Hout can be obtained by charging a capacitor C6 via a diode D5. Since this can be easily implemented by a general technique, detailed description thereof will be omitted.

Although not described in this example, the connection determination unit 5 determines the connection of the LED module 21 after the direct-current power supply DC is supplied and the control power is outputted from the second power supply unit 7, like in Example 5. The filament detection unit 12 may also determine the connection of the fluorescent lamp La at the same timing.

As described above, if the LED module is used, information may be prepared in advance based on characteristics information of LEDs for use in the LED module. Accordingly, the lighting apparatus can supply a set current based on the prepared information, thereby preventing a breakdown or lifetime reduction due to over current flowing through the LEDs in LED module. Furthermore, since the connection/non-connection of the LED module can be detected through the wire used for detecting the characteristics of the LEDs, wiring can be reduced.

Moreover, when the LED module is connected to the illumination apparatus, the connection of the LEDs with the wrong polarity or the wrong connection between the power supply line and the signal supply line does not occur. Further, a user can easily remove the LED module from the illumination apparatus or reinstall it. If there is provided an illumination apparatus with sockets capable of receiving both the fluorescent lamp and the LED module, a user can choose which to install between the fluorescent lamp and the LED module.

Second Preferred Embodiment

Next, examples of a second preferred embodiment in accordance with the present invention will be described. Throughout the drawings, like reference numerals will be given to same parts as that in the above described examples.

Example 1

Figure 26:
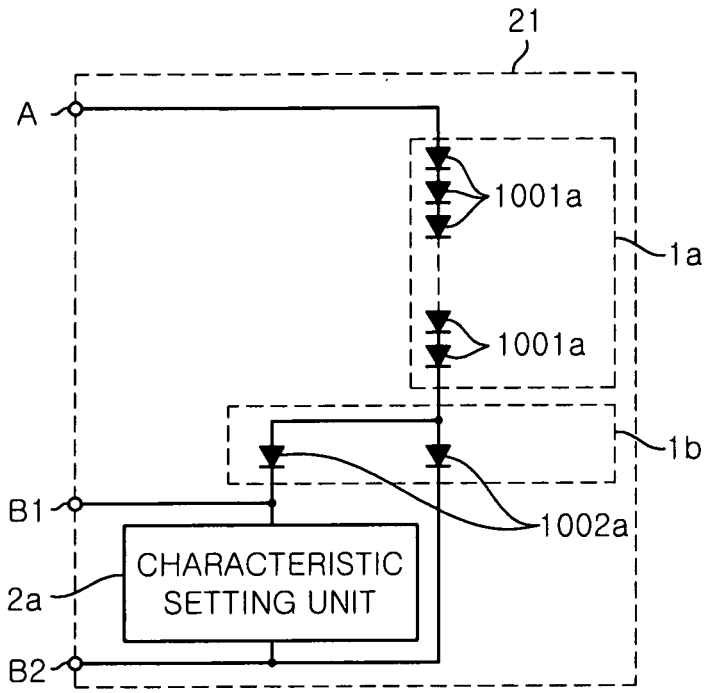
FIG. 26 is a circuit diagram of an LED module in accordance with a first example of a second preferred embodiment of the present invention.

Referring to FIG. 26, an LED module 21 in this example includes a first light source unit 1*a*, a second light source unit 1*b*, an characteristic setting unit 2*a*, a positive connecting terminal A, a negative connecting terminal B1 and a connecting terminal B2. The first light source unit 1*a* includes a plurality of LEDs, e.g., 5 LEDs 1001*a* in FIG. 26, connected in series in the forward direction, the LEDs having identical electrical characteristics. Alternatively, the first light source unit 1*a* may include multiple series circuits connected in parallel, each series circuit including multiple LEDs connected in series in the forward direction.

The second light source unit 1*b* includes multiple LEDs, e.g., 2 LEDs 1002*a* in FIG. 26, connected in parallel, the anode of each LED of the second light source unit 1*b* being coupled to the negative connecting terminal of the LEDs of the first light source unit 1*a*. The LEDs 1002*a* included in the second light source unit 1*b* have also identical electrical characteristics. Further, it is preferable that the LEDs 1001*a* of the first light source unit 1*a* and the LEDs 1002*a* of the second light source unit 1*b* have identical or similar electrical and optical characteristics to prevent uneven illumination. The number of the LEDs in the first and second source units 1*a* and 1*b* is not limited to the above number.

Figure 29:
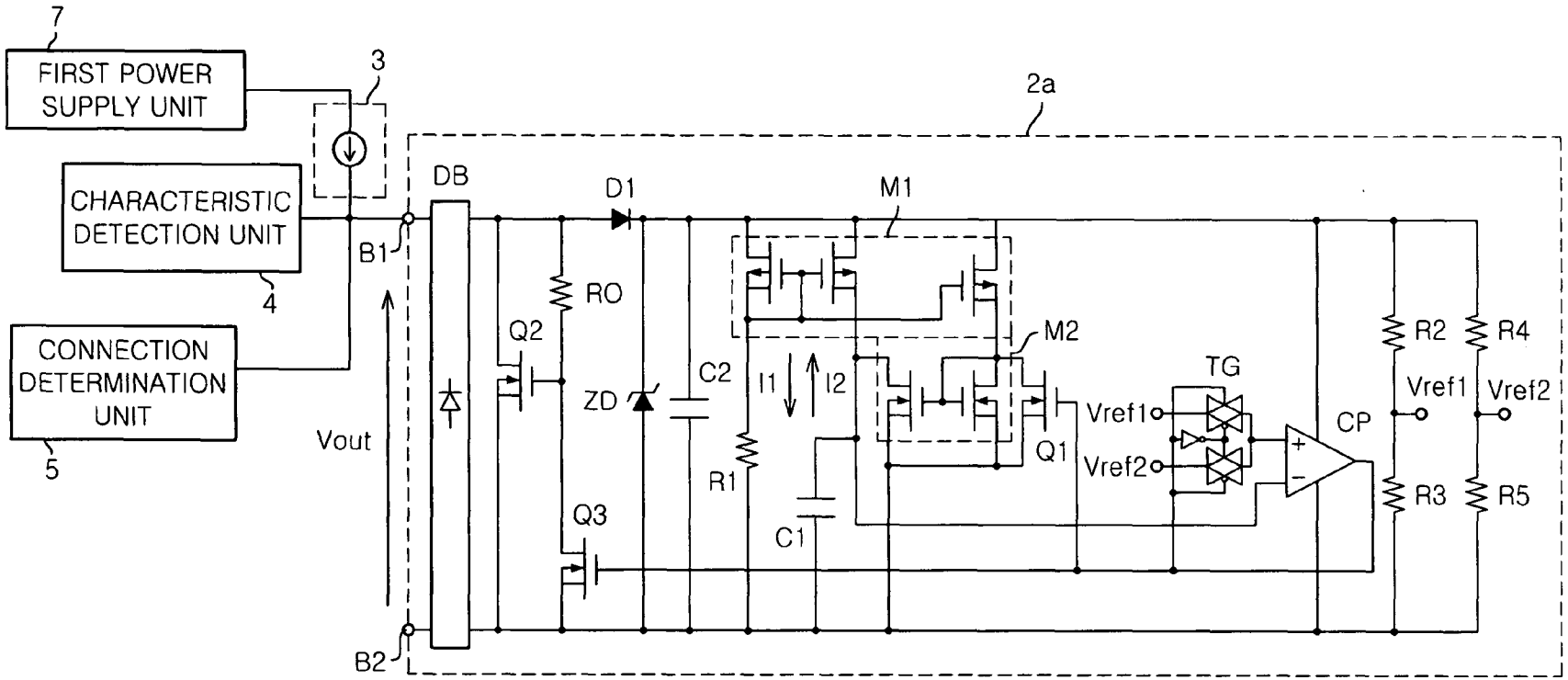
FIG. 29 describes a circuit diagram of a characteristic setting unit included in the illumination device in accordance with the first example of the second preferred embodiment of the present invention.

The characteristic setting unit 2*a* carries information on electrical characteristics such as a forward voltage or a forward current of the LEDs included in the first and second source units 1*a* and 1*b* and its circuit configuration is illustrated in FIG. 29. The circuit configuration of the characteristic setting unit 2*a* will be described later in detail.

Figure 27:
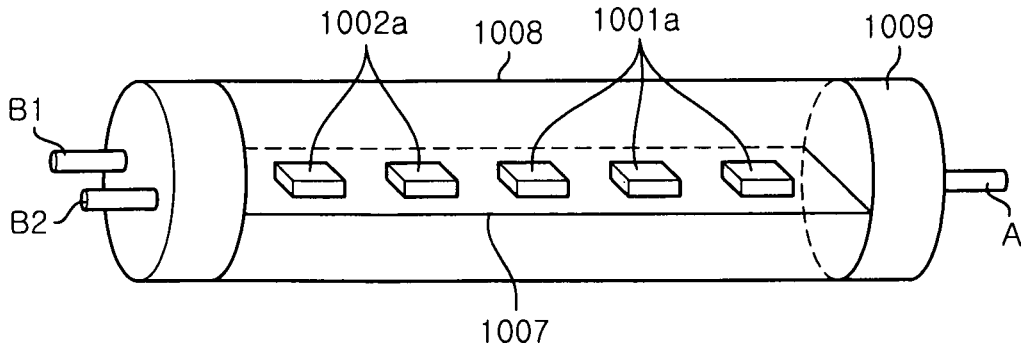
FIG. 27 is a perspective view of the LED module in accordance with the first example of the second preferred embodiment of the present invention.

As shown in FIG. 27, the first and second light source units 1*a* and 1*b* are mounted on one side, e.g., the top surface in FIG. 27, of a printed circuit board 1007 made of a long rectangular flat plate. Some of the LEDs 1001*a* are not shown. Furthermore, although not shown, the characteristic setting unit 2*a* is mounted at either lengthwise end on the other side, e.g., the bottom surface in FIG. 27) of the printed circuit board 1007. The printed circuit board 1007 is inserted into a light-transmitting cylindrical housing 1008. Each end of the housing 1008 is blocked by metal caps 1009, while each end of the printed circuit board 1007 is supported by each metal cap 1009. The connecting terminal A made of a round pin protrudes out from one metal cap 1009, whereas the connecting terminals B1 and B2 protrude out from the other metal cap 1009.

The connecting terminal A is electrically coupled to the anode of the tail LED 1001*a* of the first light source unit 1*a*. On the other hand, the negative connecting terminal B1 is electrically connected to the cathode of one of the multiple LEDs 1002*a* of the second light source unit 1*b*. Furthermore, the second negative connecting terminal B2 is electrically connected to the cathode of the LED 1002*a* which is not connected to the first negative connecting terminal B1 among the multiple LEDs 1002*a* of the second light source unit 1*b*.

Figure 28:
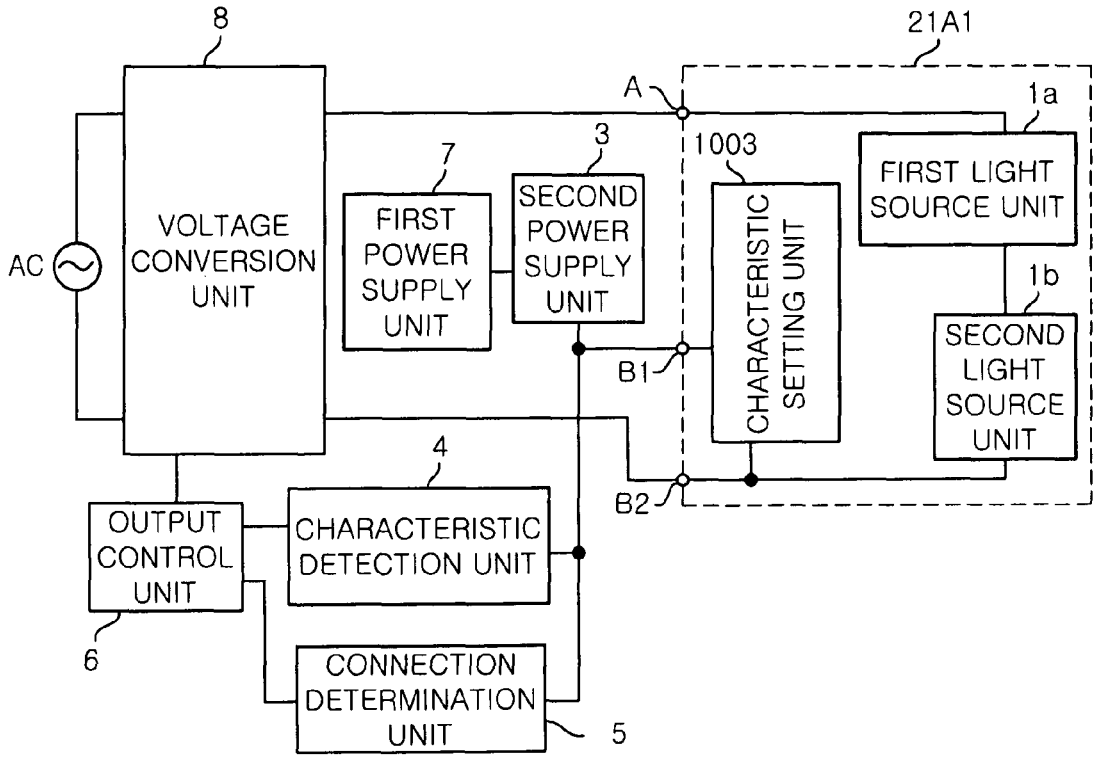
FIG. 28 represents a circuit diagram of a lighting apparatus in accordance with a first example of the second preferred embodiment of the present invention.

A lighting apparatus in this example is provided with a voltage conversion unit 8 for supplying a direct-current power to the LED module 21A1 by converting alternating-current power fed from an alternating-current power supply unit AC as shown in FIG. 28. The voltage conversion unit 8, which is formed of a well-known voltage reduction chopper circuit or a voltage reduction/boosting chopper circuit, controls switching frequency or an on-duty ratio of switching elements. Its output voltage and output current are variable. The positive output terminal of the voltage conversion unit 8 is connected to the positive connecting terminal A of the LED module 21A1, whereas the negative output terminal of the voltage conversion unit 8 is connected to either the first negative connecting terminal B1 or the second negative connecting terminal B2 of the LED module 21A1.

The lighting apparatus in this example further includes a first power supply unit 7, a second power supply unit 3, a characteristic detection unit 4, a connection determination unit 5 and an output control unit 6. The first power supply unit 7 generates control power such as direct-current power of 3.3 V or 5 V from the alternating-current power fed from the alternating-current power supply unit AC and supplies the control power to the second control power unit 3, the characteristic detection unit 4, the connection determination unit 5 and the output control unit 6. The second power supply unit 3, which is formed of a current source for converting the direct current fed from the control power supply unit 7 to constant current, supplies the constant current to the first negative connecting terminal B1 or the second negative connecting terminal B2 of the LED module 21A1.

The characteristic detection unit 4 includes a microcomputer and it measures the electrical characteristics, e.g., the forward current, of the LEDs 1001*a* and 1002*a* carried by the characteristic setting unit 2*a* of the LED module 21A1 based on a voltage waveform between the first and second negative connecting terminals B1 and B2 of the LED module 21A1 as will be described later. The connection determination unit 5 determines the connection of the LED module 21A1 to the lighting apparatus based on the voltage waveform between the first and second negative connecting terminals B1 and B2 of the LED module 21A1 as will be described later.

If the connection determination unit 5 determines that the LED module 21A1 is not connected, the output control unit 6 stops the operation of the voltage conversion unit 8. If the connection determination unit 5 determines that the LED module 21A1 is connected, the output control unit 6 adjusts either or both the output voltage and the output current of the voltage conversion unit 8 based on the electrical characteristics detected by the characteristic detection unit 4.

As shown in FIG. 29, the characteristic setting unit 2*a* of the LED module 21A1 includes a full-wave rectifier, i.e., a diode bridge, DB whose alternating-current input terminals are coupled to the first and second negative connecting terminals B1 and B2, a diode D1 whose anode is coupled to the high potential direct-current output terminal of the full-wave rectifier DB, and a parallel circuit of a smoothing capacitor C2 and a Zener diode ZD, the parallel circuit being connected between the cathode of the diode D1 and the low potential direct-current output terminal of the full-wave rectifier DB. The voltage between the direct-current output terminals of the full-wave rectifier DB is clamped to Zener voltage Vz of the Zener diode ZD and at the same time it is smoothed by the capacitor C2.

Zener current flowing through the Zener diode ZD can be controlled to a desired value by adopting a constant current source serving as the second power supply unit 3. In FIG. 29, although the second power supply unit 3 is connected to the first negative connecting terminal B1, it may be connected to the second negative connecting terminal B2. In either case, the Zener voltage Vz is generated between two ends of the smoothing capacitor C2 by the rectifying operation of the full-wave rectifier DB.

Two resistor voltage dividers are connected in parallel to the smoothing capacitor C2. One of the resistor voltage dividers is constituted by a series circuit of resistors R2 and R3, thereby creating the first reference voltage Vref1. The other resistor voltage divider is constituted by a series circuit of resistors R4 and R5, thereby creating the second reference voltage Vref2 lower than the first reference voltage Vref1. The first reference voltage Vref1 or the second reference voltage Vref2 is selectively fed to the non-inverting input terminal of a comparator CP via a transfer gate circuit TG. The comparator CP compares the voltage Vc1 of two ends of a capacitor C1 to the first reference voltage Vref1 or the second reference voltage Vref2. The capacitor C1 is charged by first mirror current I1 generated from a first mirror circuit M1. The value of the first mirror current I1 is determined by the resistive value of a resistor R1 provided outside the first mirror circuit M1.

The capacitor C1 is discharged through a second mirror circuit M2. Specifically, a switching element Q1 is coupled to the second mirror circuit M2 and, if the switching element Q1 is turned off, second mirror current I2 greater than the first mirror current I1 flows out from the capacitor C1 to thereby discharge the capacitor C1. However, if the switching element Q1 is turned on, the second mirror current I2 becomes zero and thus the capacitor C1 is charged by the first mirror current I1. On the other hand, the output terminal of the comparator CP is connected to the gate of the switching element Q1 and thus, if the output of the comparator CP is at an H level, the switching element Q1 is turned on. If the output of the comparator CP is at an L level, the switching element Q1 is turned off.

A switching element Q2 and a series circuit of a resistor R0 and a switching element Q3 are connected between the high potential output terminal of the full-wave rectifier DB and the anode of the diode D1. The gate of the switching element Q2 is connected to the connection point between the resistor R0 and the switching element Q3, i.e., to the drain of the switching element Q3. Since the gate of the switching element Q3 is connected to the output terminal of the comparator CP, if the output of the comparator CP is at an H level, the switching element Q3 is turned on and thereby the switching element Q2 is turned off. If the output of the comparator CP is at an L level, the switching element Q3 is turned off and thereby the switching element Q2 is turned on.

Next, the operation of the characteristic setting unit 2*a* will be described with reference to timing charts shown in FIG. 5. As shown in (a) of FIG. 5, if constant current from the second power supply unit 3 of the lighting apparatus is supplied as will be described later, the first mirror current I1 is supplied from the first mirror circuit M1 to the capacitor C1 and thereby the capacitor C1 is charged and the voltage Vc1 of the capacitor C1 linearly increases.

Meanwhile, since the first reference voltage Vref1 is fed to the non-inverting input terminal of the comparator CP through the transfer gate circuit TG and the voltage Vc1 of the capacitor C1 is lower than the first reference voltage Vref1, the output of the comparator CP is at an H level as shown in (b) of FIG. 5 and the second mirror current I2 becomes zero, thereby the switching element Q3 being turned on and the switching element Q2 being turned off. In (c) of FIG. 5, the potential of the first negative connecting terminal B1, which the drain of the switching element Q2 is connected to, relative to the second negative connecting terminal B2 (hereinafter, referred to as the "information carrying voltage") Vout becomes the sum voltage of the turn-on voltage of diodes forming the full-wave rectifier DB, the turn-on voltage of the diode D1 and the Zener voltage Vz.

If the voltage Vc1 of the capacitor C1 increases and reaches the first reference voltage Vref1 as shown in (a) of FIG. 5, the output of the comparator CP turns to the L level as shown in (b) of FIG. 5. Then, since the second mirror circuit M2 starts its operation and, accordingly, the capacitor C1 is discharged, the voltage Vc1 of the capacitor C1 gradually decreases as shown in (a) of FIG. 5.

The transfer gate circuit TG switches the voltage fed to the non-inverting input terminal of the comparator CP from the first reference voltage Vref1 to the second reference voltage Vref2 when the output of the comparator CP is switched from the H level to the L level in (b) of FIG. 5. Since the voltage Vc1 of the capacitor C1 is higher than the second reference voltage Vref2, the output of the comparator CP is maintained at an L level in (b) of FIG. 5. Furthermore, since the output of the comparator CP is at an L level, the switching element Q3 is turned off and the switching element Q2 is turned on. Accordingly, the information carrying voltage Vout approaches almost zero as shown in (c) of FIG. 5.

If the voltage Vc1 across the capacitor C1 reaches the second reference voltage Vref2 as shown in (a) of FIG. 5, the output of the comparator CP is switched to the H level as shown in (b) of FIG. 5 and the second mirror circuit M2 stops its operation. Thus, the capacitor C1 starts to be charged, thereby gradually increasing the voltage Vc1 of the capacitor C1 as shown in (a) of FIG. 5. The transfer gate circuit TG switches the voltage fed to the non-inverting input terminal of the comparator CP from the second reference voltage Vref2 to the first reference voltage Vref1 when the output of the comparator CP is switched from the L level to the H level in (b) of FIG. 5. Since the voltage Vc1 across the capacitor C1 is lower than the first reference voltage Vref1, the output of the comparator CP is maintained at an H level in (b) of FIG. 5.

Furthermore, since the output of the comparator CP is at an H level, the switching element Q3 is turned on and thus the switching element Q2 is turned off. Therefore, as shown in (c) of FIG. 5, the information carrying voltage Vout becomes the sum voltage of the turn-on voltage of diodes forming the full-wave rectifier DB, the turn-on voltage of the diode D1 and the Zener voltage Vz. On the other hand, while the output of the comparator CP becomes an L level and, accordingly, the switching element Q2 is being on, power discharged from the capacitor C2 is supplied to circuits including the comparator CP.

As apparent from FIG. 5, the information carrying voltage Vout, i.e., the voltage of the connecting terminal B1 has a relatively higher voltage during time T1 where the voltage Vc1 of the capacitor C1 increases and has a relatively lower voltage during time where the voltage Vc1 of the capacitor C1 decreases. T1 can be adjusted by varying the first reference voltage Vref1 and the second reference voltage Vref2. For example, if the first reference voltage is reduced to Vref1' by varying a resistance ratio, i.e., a voltage-dividing ratio, between the resistors R2 and R3, the time while the information carrying voltage Vout is at a higher voltage level is reduced to T1' as shown in FIG. 6.

Thus, the characteristic setting unit 2*a* of the LED module 21A1 in this example sets information about electrical characteristics of the LEDs 1001*a* and 1002*a* by changing at least one of the resistance ratio between the resistors R2 and R3 and the resistance ratio between the resistors R4 and R5. Further, in this example, the characteristic setting unit 2*a* is provided with the full-wave rectifier DB connected between the first and second negative connecting terminals B1 and B2. Therefore, even if the second power supply unit 3 is connected to the second negative connecting terminal B2, the characteristic setting unit 2*a* can operate in the same way as it does when the second power supply unit 3 is connected to the first negative connecting terminal B1.

The LED module 21A1 includes a first light source unit 1*a* and a second light source unit 1*b*, the first light source unit 1*a* being formed of 49 LEDs 1001*a* connected in series in the forward direction, each with electrical characteristics: a forward voltage of, e.g., 3.5 V and a forward current of, e.g., 0.3 A, and the second light source unit 1*b* being formed of two LEDs 1002*a* connected in parallel, each having same electrical characteristics as that of the first light source unit 1*a*. Here, a time period where the information carrying voltage Vout of the characteristic setting unit 2*a* is at a higher voltage level is set to be T1.

On the other hand, an LED module 21A1' includes a first light source unit 1*a*' and a second light source unit 1*b*', the first light source unit 1*a*' being formed of 49 LEDs 1001*a* connected in series in the forward direction, each with electrical characteristics: a forward voltage of 3.5 V and a forward current of 0.25 A, and the second light source unit 1*b*' being formed of two LEDs 1002*a* connected in parallel, each having same electrical characteristics as that of the first light source unit 1*a*'. In this case, a time period where the information carrying voltage Vout of the characteristic setting unit 2*a* is at a higher voltage level is set to be T1'.

When the LED module 21A1 or 21A1' is connected, the characteristic detection unit 4 detects the time period where the information carrying voltage Vout applied between the first and second negative connecting terminals B1 and B2 of the connected LED module is at a high level. Based on whether the detected time period is T1 or T1', it determines the electrical characteristics of the LED module 21A1 or 21A1', i.e., the electrical characteristics of the LEDs 1001*a* and 1002*a*.

Here, the characteristic detection unit 4 has a memory (not shown) storing a data table showing the relation between the time T1 or T1' and the electrical characteristics of the LEDs 1001*a* and 1002*a* such as set current. Thus, the characteristic detection unit 4 reads the set current corresponding to the detected time T1 and T1' from the data table and at the same time it instructs the output control unit 6 to set the output current of the voltage conversion unit 8 to be equal to the read set current.

Instead of the data table showing the relation between the time T1 and T1', and the electrical characteristics of the LEDs 1001*a* and 1002*a*, a linear function shown in FIG. 7 may be stored in the memory. By using the linear function, the electrical characteristics of the LEDs 1001*a* and 1002*a* can be derived based on the time T1 and T1'. Although the set current is used as the information about the electrical characteristics set by the characteristic setting unit 2*a*, the present invention is not limited thereto and set voltage or both the set current and the set voltage may also be carried as the information about the electrical characteristics.

On the other hand, the voltage between the terminals (not shown) of the lighting apparatus connected to the first and second negative connecting terminals B1 and B2 of the LED module 21A1 or 21A1' is equal to the control voltage Vcc of the second power supply unit 7 if the LED module 21A1 or 21A1' is not connected. If the LED module 21A1 or 21A1' is connected, the voltage is clamped to the Zener voltage Vz and thereby it becomes the information carrying voltage Vout lower than the control voltage Vcc. Accordingly, the connection determination unit 5 compares the third reference voltage Vref3, which is lower than the control voltage Vcc but higher than the information carrying voltage Vout, to the voltage between the terminals connected to the first and second negative connecting terminals B1 and B2 of the LED module 21A1 or 21A1' (hereinafter, referred to as the "detected voltage").

If the detected voltage is above the reference voltage Vref3, the LED module 21A1 or 21A1' is determined not to be connected (non-connection), and the LED module 21A1 or 21A1' is determined to be connected (connection) if the detected voltage is below the critical voltage Vref3, as shown in (a) of FIG. 8. In case of non-connection, the connection determination unit 5 sends a stop signal to both the output control unit 6 to stop the operation of the voltage conversion unit 8 and to the characteristic detection unit 4 to stop the characteristic detection operation.

Next, the operation of the connection determination unit 5 of the lighting apparatus will be described in detail with reference to timing charts shown in FIG. 8. Until t0 when the LED module 21A1 or 21A1' is not connected to the lighting apparatus as shown in (a) to (c) of FIG. 8, the operation of the voltage conversion unit 8 is stopped because a stop signal is generated from the connection determination unit 5 to the output control unit 6. If the LED module 21A1 or 21A1' is connected to the lighting apparatus at t0, constant current from the second power supply unit 3 of the lighting apparatus is supplied to the LED module 21A1 or 21A1' via either the first negative connecting terminal B1 or the second negative connecting terminal B2, thereby the smoothing capacitor C2 being charged.

Since the characteristic setting unit 2*a* is in a transition state until the voltage Vc2 of the smoothing capacitor C2 reaches the Zener voltage Vz, i.e., until t1, the characteristic detection unit 4 might misread the information about the electrical characteristics carried by the characteristic setting unit 2*a*. Therefore, the connection determination unit 5 continues sending the stop signal to both the output control unit 6 and the characteristic detection unit 4 during a predetermined time period after the connection is determined, i.e., during t0 to t1. After the operation of the characteristic setting unit 2*a* is stable, i.e., after t1, the connection determination unit 5 stops generating the stop signal to both the output control unit 6 and the characteristic detection unit 4. Accordingly, an over direct-current flow from the voltage conversion unit 8 to the LED module 21A1 or 21A1' due to the misreading of the characteristic detection unit 4 can be prevented.

Since the characteristic setting unit 2*a* operates normally when the stop signal is not generated from the connection determination unit 5 after the predetermined time period, the characteristic detection unit 4 can correctly detect information about electrical characteristics set by the characteristic setting unit 2*a*. If the information about the electrical characteristics is detected by the characteristic detection unit 4 at t2, a driving signal for driving a switching element of the chopper circuit included in the voltage conversion unit 8 is generated from the output control unit 6 to the voltage conversion unit 8. Accordingly, a direct-current output corresponding to the electrical characteristics of the LED module 21A1 or 21A1' is supplied from the voltage conversion unit 8.

As described above, since the LED module 21A1 or 21A1' in this example has the characteristic setting unit 2*a* carrying the information about the electrical characteristics of the diodes 1001*a* of the first light source unit 1*a* and the diodes 1002*a* of the second light source unit 1002, the lighting apparatus can supply an appropriate direct current based on the information, thereby preventing an over current flow not matching the electrical characteristics of the diodes 1001*a* or the diodes 1002*a*. Further, since the characteristic setting unit 2*a* is provided with the full-wave rectifier DB connected between the first and second negative connecting terminals B1 and B2, the second power supply unit 3 of the lighting apparatus can be connected to either the first negative connecting terminal B1 or the second negative connecting terminal B2, thereby avoiding complicated wiring of the lighting apparatus and the LED module 21A1 or 21A1'.

Furthermore, by increasing or decreasing the time period while the information carrying voltage Vout applied between the first and second negative connecting terminals B1 and B2 is at a higher voltage level, e.g., T1 or T1', the characteristic setting unit 2*a* can control the voltage waveform fed in through the full-wave rectifier DB based on the information of the electrical characteristics. Therefore, an electrically programmable non-volatile semiconductor memory such as flash memory is not necessary, thereby reducing the manufacturing cost of the LED module 21A1 or 21A1'. Since the characteristic detection unit 13 detects the information for the electrical characteristics of the characteristic setting unit 2*a* by using the terminals for supplying power from the second power supply unit 3, e.g., the first negative connecting terminal B1 or the second negative connecting terminal B2, wiring can be reduced.

In this example, the connection determination unit 5 of the lighting apparatus determines the connection of the LED module 1000A or 1000A' based on the voltage applied between the first and second negative connecting terminals B1 and B2 and it stops the operation of the voltage conversion unit 8 in case of non-connection. Accordingly, wiring can be reduced since no additional wiring is required to determine the connection, whereas power can be saved since the voltage conversion unit 8 stops operation if the LED module 1000A or 1000A' is not connected.

Although the LED module 21A1 in this example has the shape similar to a straight-tube fluorescent lamp, it is not limited thereto. For example, the first and second light source units 1*a* and 1*b* and the characteristic setting unit 2*a* mounted on a circular printed circuit board can be inserted into a cylindrical housing.

Example 2

Next, description will be made on Example 2 of the second embodiment in accordance with the present invention. A lighting apparatus in Example 2 can be connected to multiple LED modules, e.g., two LED modules 21A1 in FIG. 30, and it can simultaneously turn them on. Since the basic configuration of the lighting apparatus in this example is the same as that in Example 1, like reference numerals will be assigned to like parts and description thereof will be omitted. The LED module 21A1 in this example is the same as that in Example 1.

Figure 30:
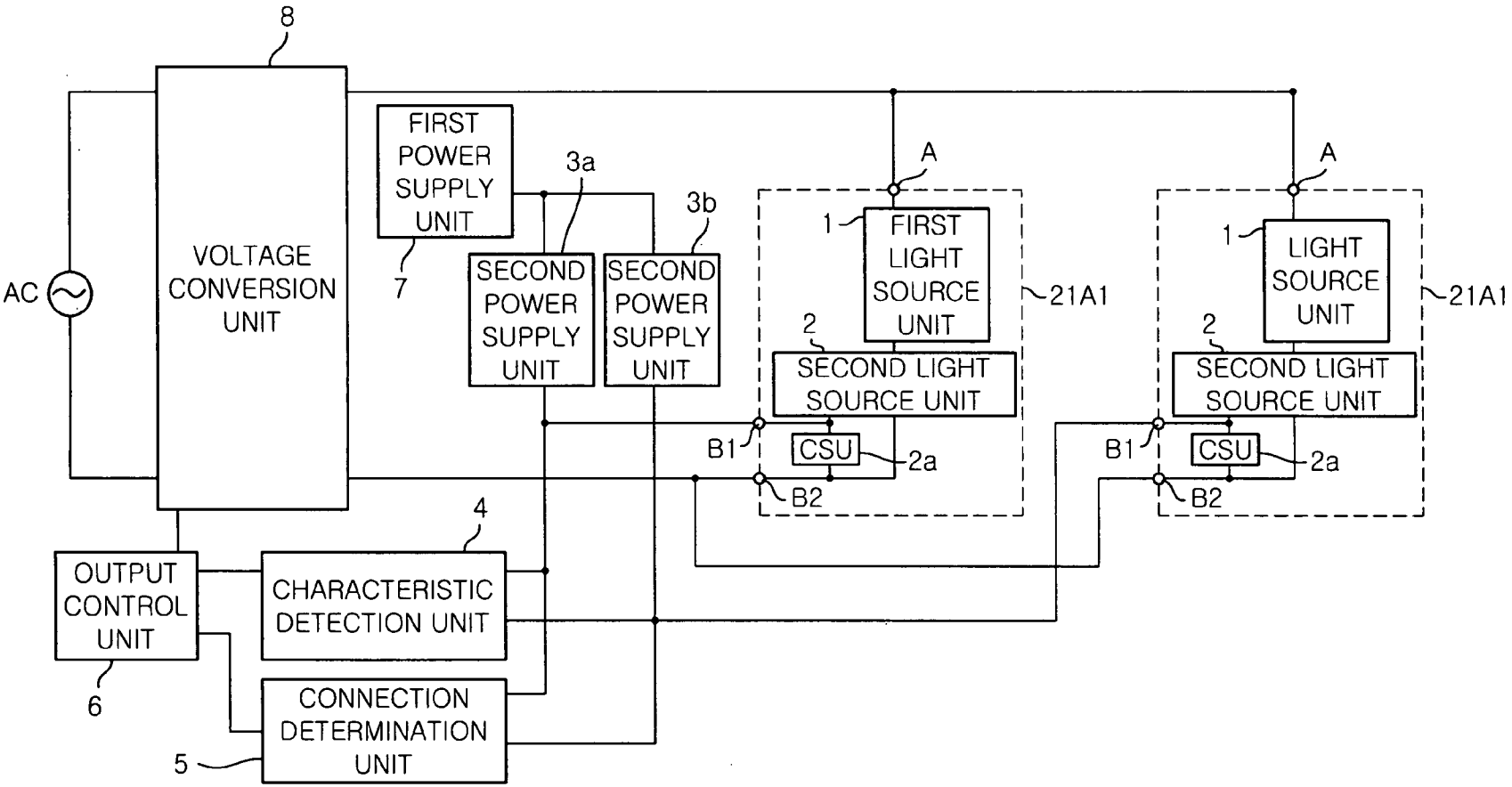
FIG. 30 illustrates a circuit diagram of an LED module and a lighting apparatus in accordance with a second example of the second preferred embodiment of the present invention.

Unlike the lighting apparatus in Example 1 of the second preferred embodiment of the present invention, the lighting apparatus in this example includes multiple second power supply units, e.g., two second power supply units 3 in FIG. 30, each supplying direct current to a first negative connecting terminal B1 or a second negative connecting terminal B2 of each LED module 21A1. Furthermore, a characteristic detection unit 4 individually detects information about electrical characteristics set in a characteristic setting unit 2*a* of the two LED modules 21A1, and a connection determination unit 5 individually determines the connection of the LED modules 21A1.

Since direct current is supplied to the two LED modules 21A1 from a single voltage conversion unit 8 of the lighting apparatus in this example, it is preferable that the LED modules 21A1 connected thereto have identical electrical characteristics. Next, the operation of the lighting apparatus if LED modules 21A1 and 21A1' with different electrical characteristics as described in Example 1 are connected will be described.

If the electrical characteristics of the LED modules 21A1 and 21A1' are different from each other, the characteristic detection unit 4 sends a stop signal to the output control unit 6 to stop the operation of the voltage conversion unit 8. In this case, both the LED modules 21A1 and 21A1' are not turned on. Alternatively, since the set current of the LED module 21A1', i.e., 0.25 A is smaller than that of the LED module 21A1, i.e., 0.3 A, the characteristic detection unit 4 may instruct the output control unit 6 so that the voltage conversion unit 8 can generate output current equal to the lower set current, i.e., 0.25 A. In this case, the output current of the voltage conversion unit 8 is divided into the LED modules 21A1 and 21A1', the current flowing through the LED module 21A1' is smaller than the set current 0.25 A but both the LED modules 21A1 and 21A1' can be turned on. The operation of the connection determination unit 5 is the same as that in Example 1, and thus description thereof will be omitted.

As described above, the lighting apparatus in this example can turn on the multiple LED modules, e.g., the LED modules 21A1 or the LED modules 21A1'. Even when the LED modules 21A1 and 21A1' with different electrical characteristics are mistakenly connected, over current does not flow through the LED modules 21A1 and 21A1', thereby preventing a breakdown of the LED modules 21A1 and 21A1'.

Example 3

Figure 31:
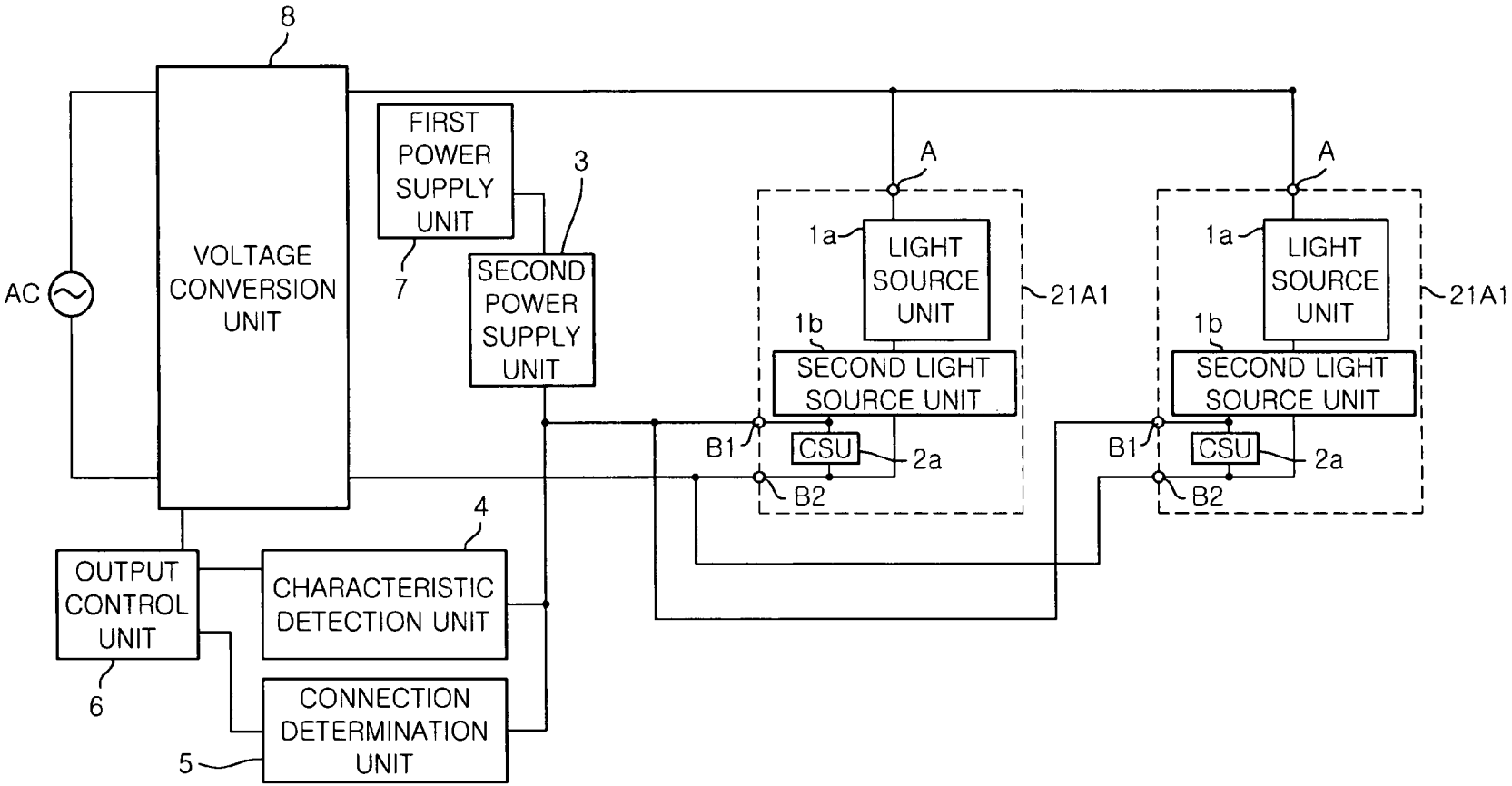
FIG. 31 illustrates a circuit diagram of an LED module and a lighting apparatus in accordance with a third example of the second preferred embodiment of the present invention.

Next, description will be made on Example 3 of the second embodiment in accordance with the present invention. Like the lighting apparatus in Example 2, a lighting apparatus in this example can be connected to multiple LED modules, e.g., two LED modules 21A2 in FIG. 31, and it can simultaneously turn them on. However, unlike the lighting apparatus in Example 2, the lighting apparatus in this example has only one second power supply unit 3 and first and second negative connecting terminals B1 and B2 of the LED modules 21A2 are connected in parallel to a characteristic detection unit 4 and a connection determination unit 5. Furthermore, the configuration of the second power supply unit 3 is different from that of the lighting apparatus in Example 2. Since the basic configuration of the lighting apparatus in this example is the same as that in Example 2, like reference numerals will be assigned to like parts and description thereof will be omitted. The LED module 21A2 in this example is the same as the LED module 21A1 in Example 1 except for the circuit configuration of a characteristic setting unit 2*a*.

Figure 32:
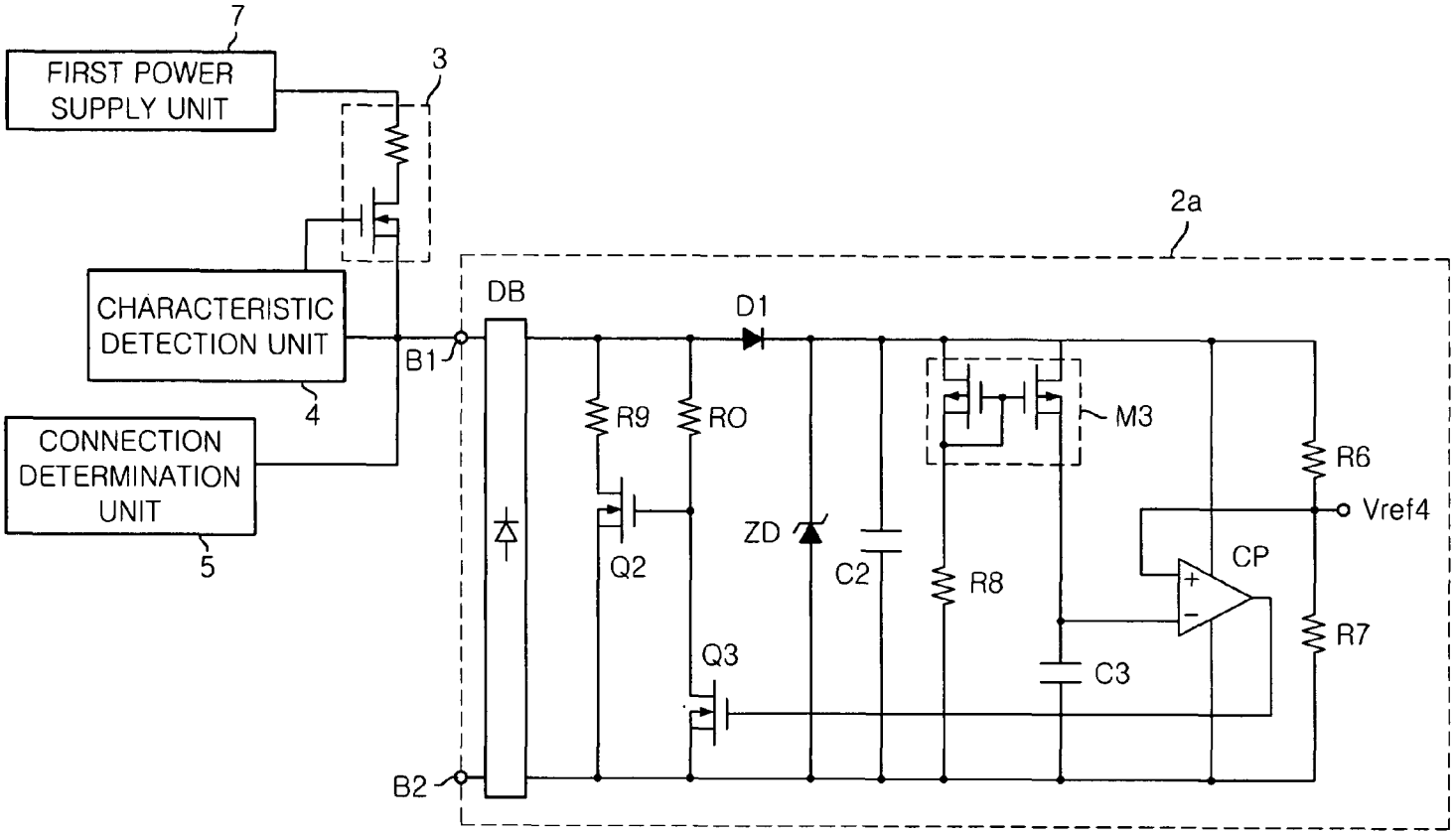
FIG. 32 describes a circuit diagram of a characteristic setting unit included in the lighting apparatus in accordance with the third example of the second preferred embodiment of the present invention.

Referring to FIG. 32, the second power supply unit 3 of the lighting apparatus in this example includes a series circuit of a resistor 3*a* and a switching element 3*b*. Switching of the switching element 3*b* is controlled by the characteristic detection unit 4. That is, only while the switching element 3*b* is being turned on by the characteristic detection unit 4, direct current is supplied from the second power supply unit 3 to the LED modules 21A2.

In the characteristic setting unit 2*a* of the LED module 21A2, the drain of a switching element Q2 is connected to both the anode of a diode D1 and the high potential direct-current output terminal of a full-wave rectifier DB via a resistor R9 as shown in FIG. 32. Zener current flowing through a Zener diode ZD is limited to a predetermined value by the resistor 3*a* of the second power supply unit 3. Although the second power supply unit 3 is connected to the first negative connecting terminal B1 in FIG. 32, it may also be connected to the second negative connecting terminal B2. Even in this case, Zener voltage Vz is applied between two ends of a smoothing capacitor C2 by the rectifying operation of the full-wave rectifier DB.

A series circuit of a mirror circuit M3 and a capacitor C3 is connected to both ends of the smoothing capacitor C2. The capacitor C3 is charged by mirror current, i.e., constant current, generated from the mirror circuit M3. This mirror current is determined by the resistive value of a resistor R8 provided outside the mirror circuit M3.

Connection point between the mirror circuit M3 and the capacitor C3 is connected to the inverting input terminal of the comparator CP. The comparator CP compares the voltage Vc3 of the capacitor C3 to a reference voltage Vref4 created by dividing the Zener voltage Vz by a voltage divider formed of resistors R6 and R7. Since the output terminal of the comparator CP is connected to the gate of the switching element Q3, if the output of the comparator CP is at H level, i.e., Vref4 is higher than the Vc3, the switching element Q3 is turned on and thereby the switching element Q2 is turned off. If the output of the comparator CP is at an L level, i.e., Vref4 is equal to or lower than Vc3, the switching element Q3 is turned off and thereby the switching element Q2 is turned on.

Next, the operation of the characteristic setting unit 2*a* will be described with reference to timing charts shown in FIG. 33. Direct current from the second power supply unit 3 is supplied to the characteristic setting unit 2*a* of the LED modules 21A2 during a predetermined time period T2 where the switching element 3*b* is being turned on by the characteristic detection unit 4 of the illuminating device, as shown in (a) of FIG. 33. Accordingly, in the characteristic setting unit 2*a*, the Zener voltage Vz is generated for the predetermined time period and thereby the mirror circuit M3 starts operating. The capacitor C3 is charged by the mirror current, and the voltage Vc3 across the capacitor C3 linearly increases as shown in (c) of FIG. 33.

While the voltage Vc3 of the capacitor C3 is below the reference voltage Vref4, the output of the comparator CP is at an H level as shown in (d) of FIG. 33, thereby the switching element Q3 being turned on and the switching element Q2 being turned off. As shown in (e) of FIG. 33, the potential of the first negative connecting terminal B1 connected to the drain of the switching element Q2 relative to the second negative connecting terminal B2, i.e., the information carrying voltage Vout becomes the sum voltage of the turn-on voltages of diodes forming the full-wave rectifier DB, the turn-on voltage of the diode D1 and the Zener voltage Vz.

Figure 33:
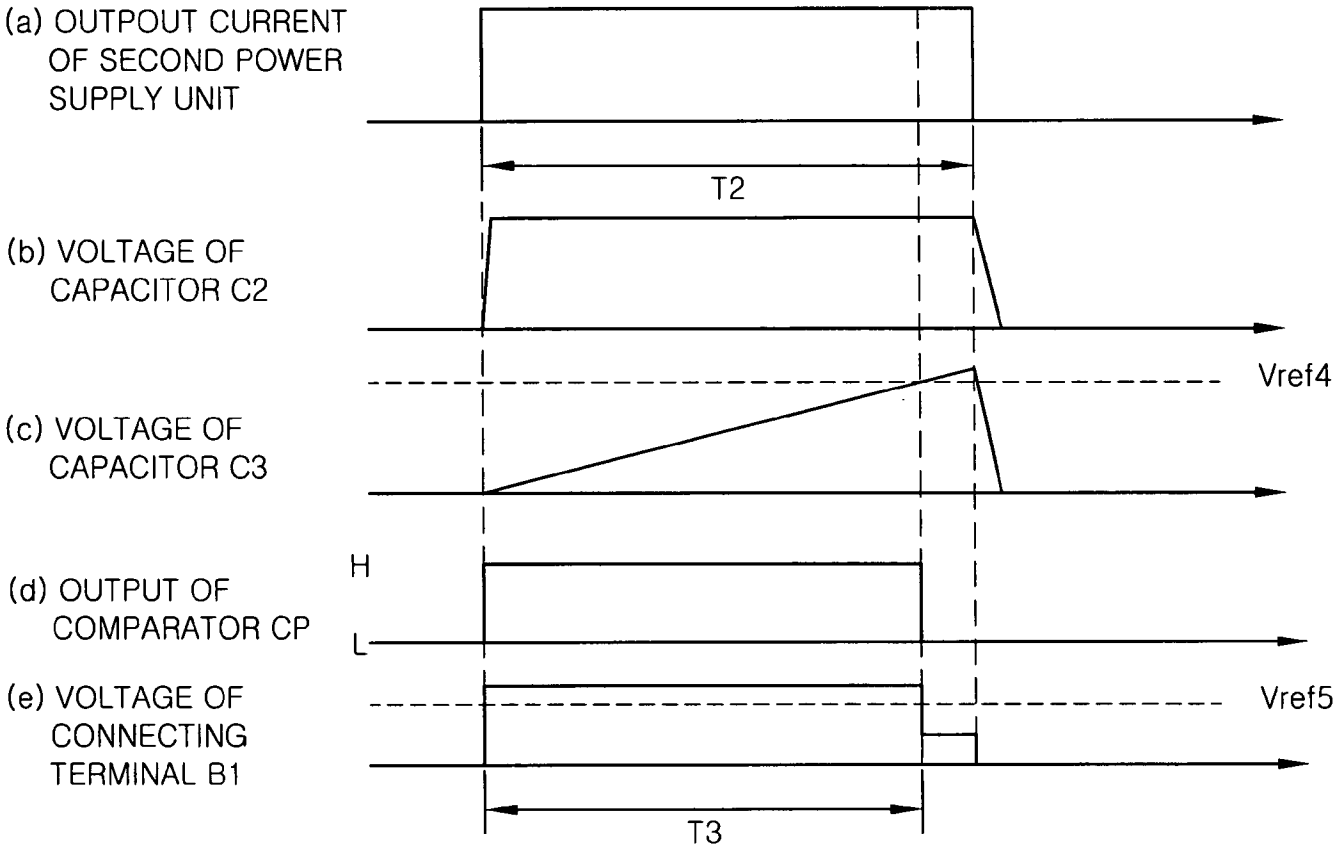
FIG. 33 provides a timing chart for illustrating the operation of the lighting apparatus in accordance with the third example of the second preferred embodiment of the present invention.

If the voltage Vc3 across the capacitor C3 increases and reaches the reference voltage Vref4 in (c) of FIG. 33, the output of the comparator CP turns to the L level as shown in (d) of FIG. 33, thereby the switching element Q3 being turned off and the switching element Q2 being turned on. At this time, the information carrying voltage Vout is reduced to the voltage obtained by dividing control voltage fed from the first power supply unit 7 by a voltage divider constituted by the resistor 3*a* of the second power supply unit 3 and the resistor R9 connected to the drain of the switching element Q2, as shown in (e) of FIG. 33.

Here, a time period where the information carrying voltage Vout is at a relatively higher voltage level within predetermined time period T2, i.e., a high voltage time period T3, varies depending on the reference voltage Vref4. By reducing the reference voltage Vref4 by changing a resistance ratio, i.e., a voltage-dividing ratio between the resistors R6 and R7, the high voltage time period T3 can be reduced. Accordingly, the characteristic setting unit 2*a* of the LED module 21A2 in this example carries information about electrical characteristics of the LEDs 1001*a* and 1002*a* by the resistance ratio between the resistors R6 and R7.

Further, since the characteristic setting unit 2*a* is provided with the full-wave rectifier DB connected between the first and second negative connecting terminals B1 and B2, it is apparent that, although the second power supply unit 3 is connected to the second negative connecting terminal B2, the characteristic setting unit 2*a* operates in the same way as it does when the second power supply unit 3 is connected to the first negative connecting terminal B1.

On the other hand, the characteristic detection unit 4 detects the high voltage time period T3 by comparing the information carrying voltage Vout with a predetermined reference voltage Vref5 as shown in (e) of FIG. 33, and determining the electrical characteristics of the LED module 21A2 based on the detected high voltage time period T3.

As described in Example 2, it is considered that two types of LED modules 21A2 and 21A2' having different electrical characteristics are mistakenly connected to the illuminating device. For example, the LED module 21A2 has electrical characteristics: a set voltage of 3.5 V and a set current of 0.3 A, and the LED module 21A2' has electrical characteristics: a set voltage of 3.5 V and a set current of 0.25 A. Furthermore, the high voltage time period T3 in direct proportion to the set current is prepared as the information about the electrical characteristics.

In this case, the first and second negative connecting terminals B1 and B2 of the two types of the LED modules 21A2 and 21A2' are connected in parallel to the characteristic detection unit 4, and the characteristic detection unit 4 detects first the electrical characteristics of the LED module 21A2' with relatively shorter high voltage time period T3. Accordingly, the characteristic detection unit 4 can instruct the output control unit 6 so that the voltage conversion unit 8 can generate output current equal to the lower set current, i.e., 0.25 A, which turns on both the LED modules 21A2 and 21A2'. Since the determination operation of the connection determination unit 5 is the same as that in Example 1, description thereof will be omitted.

As described above, the lighting apparatus of this example can turn on the multiple LED modules, e.g., the LED modules 21A or the LED modules 21A2'. Even when the LED modules 21A2 and 21A2' having the different electrical characteristics are mistakenly connected, over current does not flow through the LED modules 21A2 and 21A2', thereby preventing a breakdown of the LED modules 21A2 and 21A2'. Furthermore, wiring for connecting the lighting apparatus with the LED modules 21A2 as well as the circuit configuration of the characteristic setting unit 2*a* of the LED modules 21A2 and 21A2' can be simplified compared to Example 1 or 2.

Example 4

Figure 34:
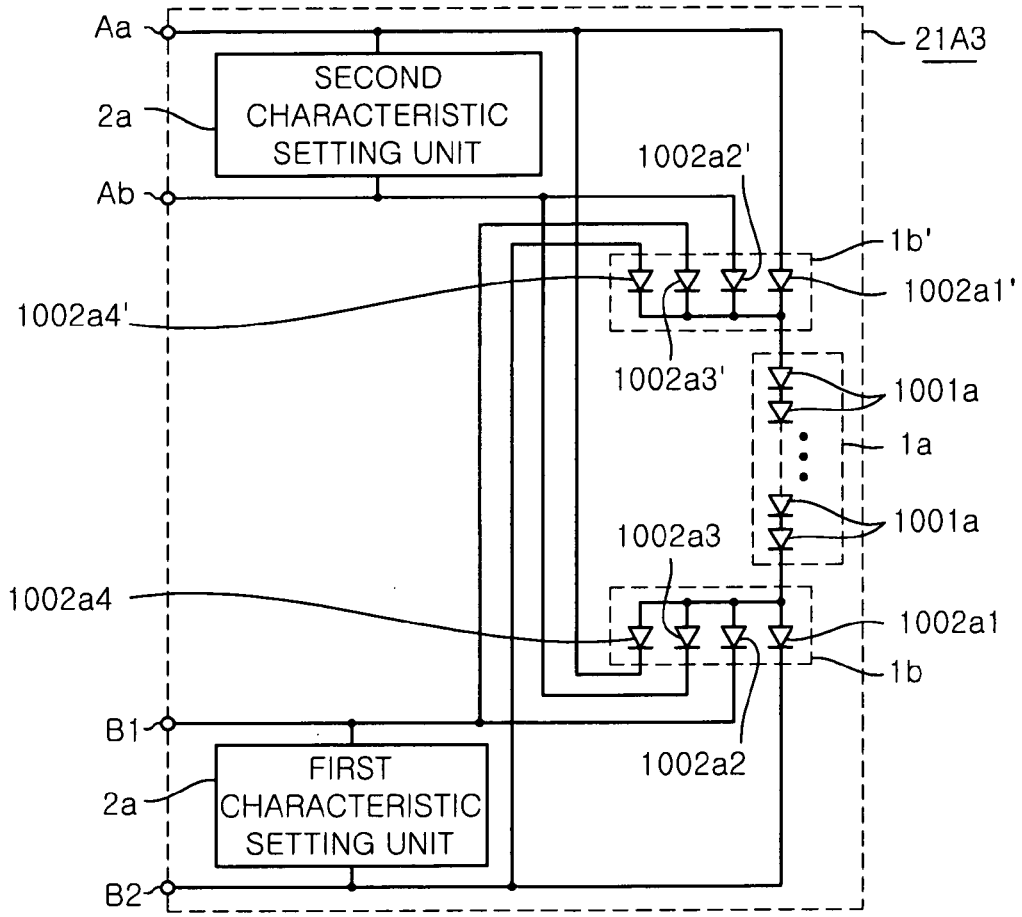
FIG. 34 illustrates a circuit diagram of an LED module in accordance with a fourth example of the second preferred embodiment of the present invention.

FIG. 34 is a circuit diagram of an LED module 21A3 of Example 4. The LED module 21A3 includes a third light source unit 1*b*' formed of multiple LEDs, e.g., 4 LEDs 1002*a*1' to 1002*a*4' in FIG. 34, connected in parallel. In the third light source unit 1*b*', the cathode of each LED is coupled to the anode of a tail LED 1001*a* of a first light source unit 1*a*. The LED module 21A3 further includes a first positive terminal Aa connected to the anode of the LED 1002*a*1' of the third light source unit 1*b*', a second positive terminal Ab connected to the anode of the LED 1002*a*2' which is not connected to the first positive terminal Aa, and a second characteristic setting unit 2*a*' for carrying the same information as that in the characteristic setting unit 2*a*, the second characteristic setting unit 2*a*' being connected between the first and second positive terminals Aa and Ab.

Among the multiple LEDs 1002*a*1' to 1002*a*4' of the third light source unit 1*b*', each anode of the LEDs 1002*a*3' and 1002*a*4', which are not connected to either the first positive connecting terminal Aa or the second positive connecting terminal Ab, is connected to first and second negative connecting terminals B1 and B2, respectively. Further, among multiple LEDs, e.g., 4 LEDs 1002*a*1 to 1002*a*4 in FIG. 34, of a second light source unit 1*b*, each cathode of the LEDs 1002*a*3 and 1002*a*4, which are not connected to either the first negative connecting terminal B1 or the second negative connecting terminal B2, is connected to the first and second positive connecting terminals Aa and Ab, respectively.

Here, it is preferable that the LEDs 1001*a* of the first light source unit 1*a*, the LEDs 1002*a*1 to 1002*a*4 of the second light source unit 1*b*, and the LEDs 1002*a*1' to 1002*a*4' of the third light source unit 1*b*' have identical or similar electrical and optical characteristics to each other to prevent uneven illumination. The number of the LEDs 1001*a*, 1002*a*1 to 1002*a*4, and 1002*a*1' to 1002*a*4' is not limited to the above number. Since the circuit configuration of the characteristic setting unit 2*a* and the second characteristic setting unit 2*a*' is the same as that of the LED module 21A1 or 21A2 in Example 1, 2 or 3, description thereof will be omitted.

On the route from the first positive connecting terminal Aa to the second negative connecting terminal B2, the LED 1002*a*1' of the third light source unit 1*b*', the LEDs 1001*a* of the first light source unit 1*a* and the LED 1002*a*1 of the second light source unit 1*b* are connected in the forward direction. Furthermore, on the route from the first positive connecting terminal Aa to the first negative connecting terminal B1, the LED 1002*a*1' of the third light source unit 1*b*', the LEDs 1001*a* of the first light source unit 1*a* and the LED 1002*a*2 of the second light source unit 1*b* are connected in the forward direction.

If the positive output terminal of the lighting apparatus is connected to the first positive connecting terminal Aa and, at the same time, its negative output terminal and the output terminal of the second power supply unit 3 are connected to the first and second negative connecting terminals B1 and B2, respectively, or vice versa, the characteristic detection unit 4 of the lighting apparatus can detect electrical characteristics of the characteristic setting unit 2*a* connected between the first and the second negative connecting terminals B1 and B2, and the LED module 21A3 can be turned on by appropriate direct current supplied thereto.

Likewise, on the route from the second positive connecting terminal Ab to the second negative connecting terminal B2, the LED 1002*a*2' of the third light source unit 1*b*', the LEDs 1001*a* of the first light source unit 1*a* and the LED 1002*a*1 of the second light source unit 1*b* are connected in the forward direction. Furthermore, on the route from the second positive connecting terminal Ab to the first negative connecting terminal B1, the LED 1002*a*2' of the third light source unit 1*b*', the LEDs 1001*a* of the first light source unit 1*a* and the LED 1002*a*2 of the second light source unit 1*b* are connected in the forward direction.

Thus, although the positive output terminal of the lighting apparatus is connected to the second positive connecting terminal Ab and, at the same time, its negative output terminal and the output terminal of the second power supply unit 3 are connected to the first and second negative connecting terminals B1 and B2, respectively, or vice versa, the characteristic detection unit 4 of the lighting apparatus can detect electrical characteristics of the characteristic setting unit 2*a* connected between the first and the second negative connecting terminals B1 and B2, and the LED module 21A3 can be turned on by appropriate direct current supplied thereto.

On the other hand, on the route from the first negative connecting terminal B1 to the second positive connecting terminal Ab, the LED 1002*a*3' of the third light source unit 1*b*', the LEDs 1001*a* of the first light source unit 1*a* and the LED 1002*a*3 of the second light source unit 1*b* are connected in the forward direction. Furthermore, on the route from the first negative connecting terminal B1 to the first positive connecting terminal Aa, the LED 1002*a*3' of the third light source unit 1*b*', the LEDs 1001*a* of the first light source unit 1*a* and the LED 1002*a*4 of the second light source unit 1*b* are connected in the forward direction.

If the positive output terminal of the lighting apparatus is connected to the first negative connecting terminal B1 and, at the same time, its negative output terminal and the output terminal of the second power supply unit 3 are connected to the first and second positive connecting terminals Aa and Ab, respectively, or vice versa, the characteristic detection unit 4 of the lighting apparatus can detect electrical characteristics of the second characteristic setting unit 2*a*' connected between the first and the second positive connecting terminals Aa and Ab, and the LED module 21A3 can be turned on by appropriate direct current supplied thereto.

Likewise, on the route from the second negative connecting terminal B2 to the second positive connecting terminal Ab, the LED 1002*a*4' of the third light source unit 1*b*', the LEDs 1001*a* of the first light source unit 1*a* and the LED 1002*a*3 of the second light source unit 1*b* are connected in the forward, direction. Furthermore, on the route from the second negative connecting terminal B2 to the first positive connecting terminal Aa, the LED 1002*a*4' of the third light source unit 1*b*', the LEDs 1001*a* of the first light source unit 1*a* and the LED 1002*a*4 of the second light source unit 1*b* are connected in the forward direction.

Thus, although the positive output terminal of the lighting apparatus is connected to the second negative connecting terminal B2 and, at the same time, its negative output terminal and the output terminal of the second power supply unit 3 are connected to the first and second positive connecting terminals Aa and Ab, respectively, or vice versa, the characteristic detection unit 4 of the lighting apparatus can detect electrical characteristics of the second characteristic setting unit 2*a*' connected between the first and the second positive connecting terminals Aa and Ab, and the LED module 21A3 can be turned on by appropriate direct current supplied thereto.

Since the LED module 21A3 in this example has no restriction on the connection of the output terminal of the lighting apparatus to the first and second positive connecting terminals Aa and Ab and the first and second negative connecting terminals B1 and B2 as described above, there cannot occur wrong connection of the LED module to the illuminating device.

Figure 35:
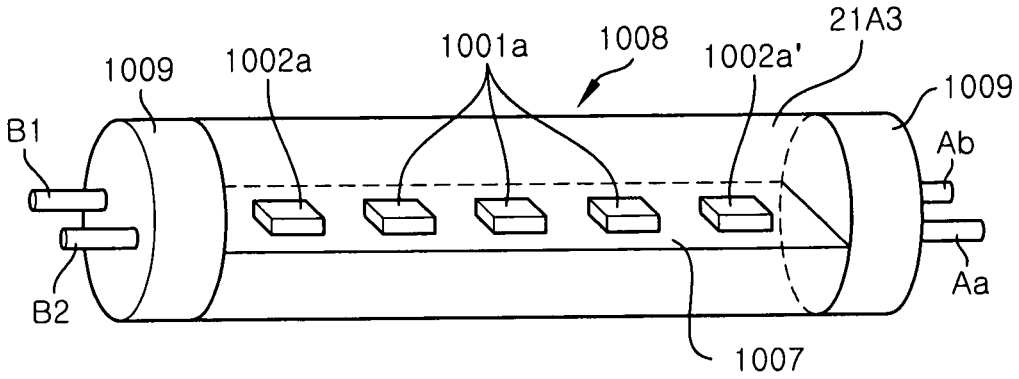
FIG. 35 shows a perspective view of the LED module in accordance with the fourth example of the second preferred embodiment of the present invention.
Figure 36:
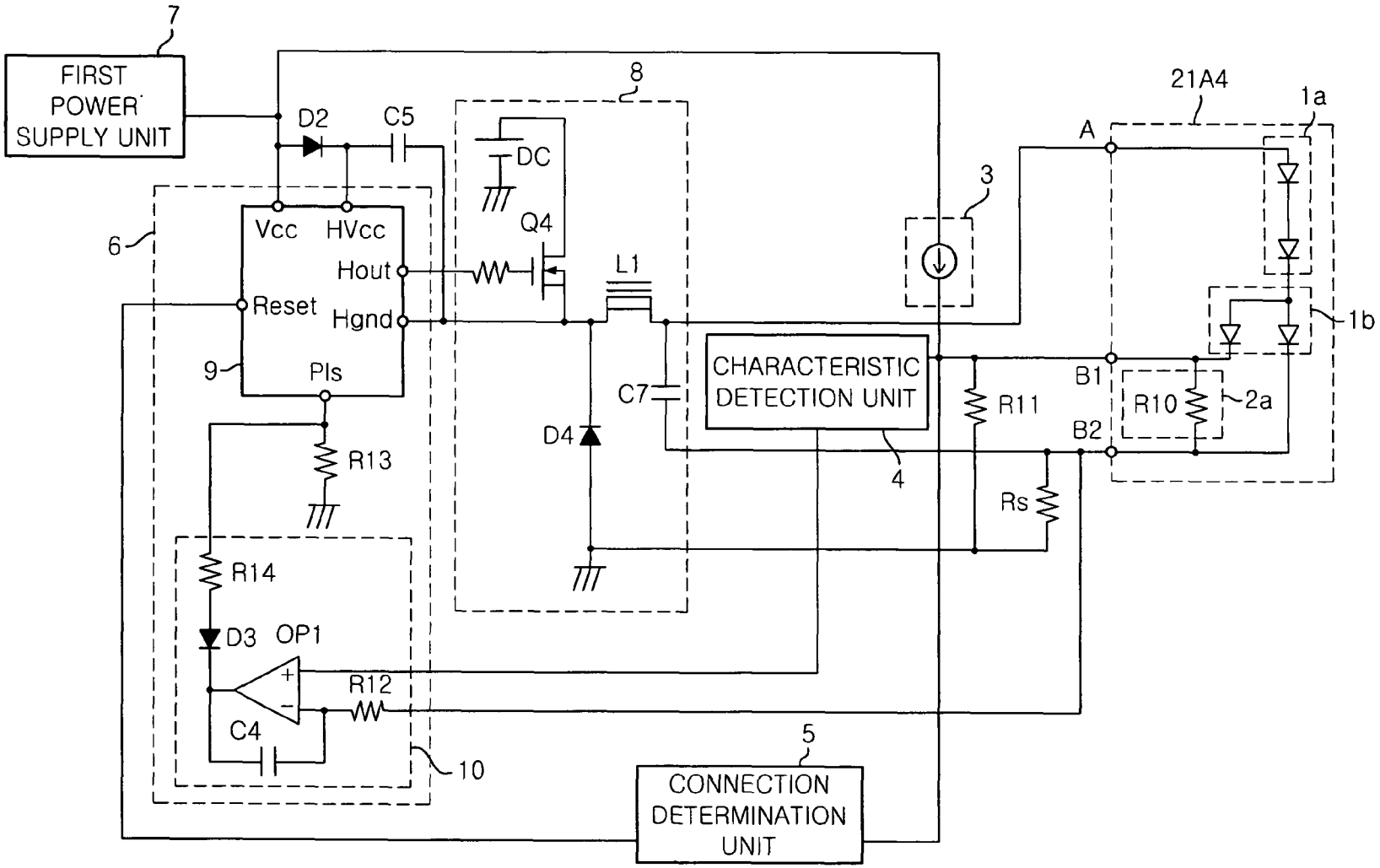
FIG. 36 illustrates a circuit diagram of an LED module and a lighting apparatus in accordance with a fifth example of the second preferred embodiment of the present invention.

As shown in FIG. 35, LEDs 1001*a* of the first light source unit 1*a*, a LED 1002*a* of the second light source unit 1*b* and a LED 1002*a*' of the third light source unit 1*b*' are mounted on one side, e.g., the top surface in FIG. 35, of a printed circuit board 1007 made of a long rectangular flat plate. Some of the LEDs 1001*a* are not shown. Although not shown, the characteristic setting unit 2*a* is mounted on the other side, e.g., the bottom surface in FIG. 35) of the printed circuit board 1007 and it is mounted at one lengthwise end, i.e., where the first and second negative connecting terminals B1 and B2 are disposed, whereas the second characteristic setting unit 2*a*' is mounted at the other end.

The printed circuit board 1007 is received in a light-transmitting cylindrical housing 1008. The first and second positive connecting terminals Aa and Ab formed of a round pin protrude out from one metal cap 1009 blocking both ends of the housing 1008, and the first and second negative connecting terminals B1 and B2 formed of a round pin protrude out from the other metal cap 1009. Furthermore, the first and second positive connecting terminals Aa and Ab and the first and second negative connecting terminals B1 and B2 have the same shape, size and are spaced equally.

The LED module 21A3 of this example is installed in an illumination apparatus as shown in FIG. 16. This illumination apparatus includes a apparatus main body 20 directly attached to a ceiling and a pair of sockets 23 and which the LED module 21A3 can be connected to or disconnected from, the sockets 23 and 24 being disposed at the apparatus main boy 20.

A lighting apparatus is installed inside the apparatus main body 20 of a long prism shape whose shape viewed in the lengthwise direction is trapezoidal. The sockets 23 and 24 are installed at both lengthwise ends on the bottom surface of the apparatus main body 20. These sockets 23 and 24 have the same configuration as those of conventional cylindrical fluorescent lamps. The first and second positive connecting terminals Aa and Ab and the first and second negative connecting terminals B1 and B2 of the LED module 21A3 are connected to the lighting apparatus via the sockets 23 and 23.

The LED module 21A3 in this example has no restriction on the connection of the output terminal of the lighting apparatus to the first and second positive connecting terminals Aa and Ab and the first and second negative connecting terminals B1 and B2, and furthermore, the first and second positive connecting terminals Aa and Ab and the first and second negative connecting terminals B1 and B2 have the same shape, size and are spaced equally as described above. Because of this, there is no restriction on the connection of the sockets 23 and 24 of the illumination apparatus. Accordingly, installation of the LED module 21A3 or wiring between the lighting apparatus installed in the apparatus main body 20 and the sockets 23 and 24 can be much easier.

Example 5

FIG. 37 is a circuit diagram of a lighting apparatus of Example 5. Like reference numerals will be assigned to like parts from the lighting apparatus in Examples 1 to 4 and description thereof will be omitted. An LED module 21A4 in this example is the same as the LED module 21A in Example except that a characteristic setting unit 2*a* is constituted by a resistor R10.

A voltage conversion unit 8 of the lighting apparatus is constituted by a well-known voltage reduction chopper circuit. Specifically, the voltage conversion unit 8 includes a switching element Q4 whose drain is connected to the positive terminal of a direct-current power supply unit DC, and an inductor L1 whose one end is connected to the source of the switching element Q4. Further, the voltage conversion unit 8 includes a diode D4 whose cathode is connected to the source of the switching element Q4 and whose anode is grounded and a capacitor C7 whose high potential terminal is connected to the other end of the inductor L1 and whose low potential terminal is connected to the anode of the diode D4 via a detection resistor Rs. The direct-current power supply DC can be obtained either by rectifying and smoothing alternating-current power or by using a voltage boosting chopper circuit.

The output control unit 6 includes a driver circuit 9 for generating a driving signal to the gate of the switching element Q4 of the voltage conversion unit 8 and a feedback control circuit 10 for controlling ON-time Ton of the driving signal generated from the driver circuit 9. The feedback control circuit 10 is constituted by an operational amplifier OP1, a resistor R11 connected to the inverting input terminal of the operational amplifier OP1, a capacitor C4 connected between the inverting input terminal and the output terminal of the operational amplifier OP1, a diode D3 whose cathode is connected to the output terminal of the operational amplifier OP1, and a resistor R14 connected to the anode of the diode D3.

Voltage detected at the detection resistor Rs, which is in proportion to output current of the voltage conversion unit 8, is fed to the inverting input terminal of the operational amplifier OP1 via the resistor R12, and a current setting signal outputted from the characteristic detection unit 4 is fed to the non-inverting input terminal of the operational amplifier OP1. A well-known integrator circuit is constituted by the operational amplifier OP1, the resistor R12 and the capacitor C4.

The non-inverting input terminal of the operational amplifier OP1, which is usually grounded, is connected to the output terminal of the characteristic detection unit 4. Thus, the operational amplifier OP1 integrates a voltage obtained by adding the detected voltage to the voltage (i.e., offset voltage) of the current setting signal, and outputs the integrated result from the output terminal thereof. For that reason, as the voltage of the current setting signal increases based on the set current carried in the characteristic setting unit 2*a* of the LED module 21A4, the output voltage of the operational amplifier OP1 decreases.

The driver circuit 9, which may be constituted by a general purpose integrated circuit, includes an output terminal Hout generating a driving signal, an ON-pulse width control terminal Pls for controlling ON-time Ton, a control power terminal Vcc through which control power from a first power supply unit 7 is supplied and a reset terminal Reset for stopping the generation of the driving signal. In the driver circuit 9, connected to the ON-pulse width control terminal Pls is a circuit including, e.g., a constant voltage buffer circuit, a current mirror circuit and a driving signal setting capacitor.

The ON-pulse width control terminal Pls connected to the output terminal of the constant voltage buffer circuit is grounded via a resistor R13 connected outside the ON-pulse width control terminal Pls, and current Ipls flowing from the ON-pulse width control terminal Pls to the resistor R13 is equal to the current generated by the current mirror circuit. A time period until the voltage of the driving signal setting capacitor charged by output current of the current mirror circuit reaches a predetermined voltage becomes ON-time Ton. The connection point between the ON-pulse width control terminal Pls and the resistor R13 is connected to the output terminal of the operational amplifier OP1 via the resistor R14 and the diode D3. Thus, as the output voltage of the operational amplifier OP1 decreases, the current Ipls from the ON-pulse width control terminal Pls increases, resulting in a reduction of ON-time Ton as shown in FIG. 18.

Thus, if the output current of the voltage conversion unit 8 increases, the voltage detected at the detection resistor Rs increases and thereby the output voltage of the operational amplifier OP1 of the feedback control circuit 10 is reduced. Accordingly, ON-time Ton of the driving signal generated from the output terminal Hout of the driver circuit 9 is reduced and thereby the output current of the voltage conversion unit 8 is reduced.

Between a control power terminal Vcc and a control power boosting terminal HVcc of the driver circuit 9, a rectification diode D12 is connected, while a capacitor C5 is connected between a control power boosting ground terminal Hgnd and the cathode of the diode D12, the terminal Hgnd being connected to the source of the switching element Q4 of the voltage conversion unit 8. Power for the driving signal generated from the output terminal Hout is produced by the voltage charged in the capacitor C5 provided outside the driver circuit 9.

Next, the operations of the characteristic setting unit 2*a*, the characteristic detection unit 4 and the connection determination unit 5 in this example will be described.

If the LED module 21A4 is connected to the lighting apparatus but the voltage conversion unit 8 is not operating, by using the detection resistor Rs having a resistive value less than a few ohms and the resistor R10 having a resistive value greater than a few tens of kilohms, effect of the detection resistor Rs on the information carrying voltage Vout applied between the first and second negative connecting terminals B1 and B2 can be ignored. Namely, the information carrying voltage Vout can be regarded as determined only by the current value of the direct current supplied from the second power supply unit 3 and the resistive value of the resistor R10 of the characteristic setting unit 2*a*. Accordingly, if the information carrying voltage Vout varies in proportion to the resistive value of the resistor R10, information about electrical characteristics such as the set current Iout can be represented by the resistive value of the resistor R10 in the characteristic setting unit 2*a* as shown in FIG. 19.

On the other hand, if the LED module 21A4 is connected to the lighting apparatus and the voltage conversion unit 8 is operating, and if the set current Iout of the LED module 21A4 is, e.g., 0.35 A, a peak current flowing through the inductor L1 of the voltage conversion unit 8 is about 0.70 A. The voltage across the detection resistor Rs having a resistive value of 1 ohm varies in the range from 0 V to 0.7 V, while the information carrying voltage Vout varies depending on the switching operation of the switching element Q4. In order to correctly detect the electrical characteristic of the LED module 21A4 based on the information carrying voltage Vout, it is preferred that the characteristic detection unit 4 performs the detection when the voltage conversion unit 8 is not operating.

If the LED module 21A4 is not connected, the direct current from the second power supply unit 3 flows through the resistor R11 connected between the output terminal of the second power supply unit 3 and the ground, thereby increasing the voltage between two ends of the resistor R11, i.e., the information carrying voltage Vout. If the information carrying voltage Vout is above a reference voltage Vref6, the connection determination unit 5 determines that the LED module 21A4 is not connected and then generates a stop signal. However, if the information carrying voltage Vout is below the reference voltage Vref6, the connection determination unit 5 determines that the LED module 21A4 is connected and thus does not generate a stop signal. While the stop signal is fed to the reset terminal Reset of the driver circuit 9 of the output control unit 6, no driving signal is generated from the output terminal Hout of the driver circuit 9 and thereby the voltage converting unit 8 stops.

Next, the operation until the LED module 21A4 turns on after the direct-current power DC is supplied will be described in detail with reference to timing charts shown in FIG. 20.

After the direct-current power DC is supplied, the control voltage of the first power supply unit 7 gradually increases as shown in (a) and (b) of FIG. 20. If the control power reaches a predetermined level at to, constant direct current is generated from the second power supply unit 3 as shown in (c) of FIG. 20. Although both the characteristic detection unit 4 and the connection determination unit 5 start operating at t0, the connection determination unit 5 keeps generating a stop signal during a predetermined time period after t0, i.e., during a time period from t0 to t2, regardless of the connection of the LED module 21A4 as shown in (d) of FIG. 20.

In the meantime, the characteristic detection unit 4 detects information about electrical characteristics such as set current based on the information carrying voltage Vout during a time period from t0 to t1, t1 being shorter than t2, and then generates a current setting signal corresponding to the detected set current as shown in (e) of FIG. 20.

At t2, if the LED module 21A4 is connected to the illuminating device, the connection determination unit 5 determines there is a connection and thus stops generating a stop signal as shown in (d) of FIG. 20. Therefore, a driving signal is generated from the output control unit 6 to thereby start the operation of the voltage conversion unit 8 as shown in (f) of FIG. 20.

If the LED module 21A4 is not connected to the lighting apparatus at t2, the connection determination unit 5 determines there is no connection and keeps generating a stop signal. Thus, no driving signal is generated from the output control unit 6 and thereby the voltage converting unit 8 does not start operating. Meanwhile, the characteristic detection unit 4 repeats the characteristic detection.

If the first and second negative connecting terminals B1 and B2 of the LED module 21A4 are short-circuited by a breakdown or the like of the characteristic setting unit 2*a*, the information carrying voltage Vout approaches almost zero. To this end, it is preferable that the connection determination unit 5 compares the information carrying voltage Vout with a reference voltage Vref7 set to be lower than the reference voltage Vref6, and generates a stop signal to stop the operation of the voltage conversion unit 8 when the information carrying voltage Vout is below the reference voltage Vref7.

The characteristic detection unit 4 may stop detecting the characteristics after a driving signal is generated from the output control unit 6. Further, the set current Iout as the information about the electrical characteristics may increase in stepwise for the information carrying voltage Vout as shown in FIG. 25.

With the lighting apparatus as described above in this example, the output current of the voltage conversion unit 8 is feedback controlled by the output control unit 6, thereby supplying more stable direct current to the LED module 21A4.

While the invention has been shown and described with respect to the preferred embodiments, it will be understood by those skilled in the art that various changes and modifications may be made without departing from the spirit and scope of the invention as defined in the following claims.

What is claimed is:

1. A light source module comprising:

a substrate unit for mounting multiple light emitting diodes thereon to electrically connect the light emitting diodes;

first and second electrical connecting terminal for supplying a current to the light emitting diodes based on a voltage applied from outside the substrate unit;

a characteristic setting unit for presetting characteristic information corresponding to an electrical characteristic of the light emitting diodes; and a third electrical connecting terminal for outputting a setting signal based on the characteristic information preset in the characteristic setting unit, wherein the characteristic setting unit is connected at least between the third and the first electrical connecting terminal or between the third and the second electrical connecting terminal, and the characteristic setting unit responds to a set-up power inputted from the third electrical connecting terminal to generate the setting signal, and wherein the setting signal is maintained at a specific level during a preset time period, the preset time period representing the characteristic information.

2. A lighting apparatus capable of turning on and off the light source module of claim 1, the lighting apparatus comprising:

a voltage conversion unit having at least one switching element and being adapted to receive a rectified voltage as a power source, convert the rectified voltage to a desired voltage by turning on and off the switching element and supply the desired voltage to the light source module, the rectified voltage being obtained by rectifying a direct-current voltage or an alternating-current voltage supplied from the outside;

a set-up power output unit for supplying a set-up second power to the characteristic setting unit of the light source module via the third electrical connecting terminal;

a characteristic detection unit connected to the third electrical connecting terminal of the light source module to detect the characteristic information;

a current detection unit connected to a lower potential terminal of the first and the second electrical connecting terminal to detect a current including a load current flowing through the light source module and to generate a current detection signal;

an output control unit for outputting a driving signal to the switching element to control the load current based on the detected result of the characteristic detection unit and the current detection signal; and a connection determination unit connected to the third electrical connecting terminal of the light source module to determines whether the light source module is connected or not, wherein the output control unit includes a stopping unit for stopping the output of the driving signal based on the determination result of the connection determination unit.

3. An illumination apparatus comprising the light source module of claim 1 and the lighting apparatus of claim 2.

4. A light source module comprising:

a first light source unit including multiple light emitting diodes connected in series in the forward direction;

a second light source unit including multiple light emitting diodes connected in parallel, the anode of each light emitting diode being connected to the cathode of the head light emitting diode of the first light source unit;

a positive connecting terminal connected to the anode of the tail light emitting diode of the first light source unit;

a first negative connecting terminal connected to the cathode of at least one light emitting diode of the second light source unit;

a second negative connecting terminal connected to the cathode of at least one light emitting diode among the multiple light emitting diodes of the second light source unit which is not connected to the first negative connecting terminal; and a characteristic setting unit for setting information about electrical characteristics of the light emitting diodes of the first and the second light source unit, the characteristic setting unit being connected between the first and the second negative connecting terminal, wherein a power is applied between the positive connecting terminal and the first negative connecting terminal or the second negative connecting terminal by a lighting apparatus, a direct-current voltage is applied between the first and the second negative connecting terminal from an outside power supply, and the characteristic setting unit includes a full-wave rectifier disposed between the first and the second negative connecting terminal and controls a voltage waveform inputted through the full-wave rectifier based on the information, wherein the characteristic setting unit outputs a characteristic setting signal corresponding to the information via the first and the second negative connecting terminal, and wherein the characteristic setting signal is maintained at a specific level during a preset time period, the preset time period representing the information.

5. The light source module of claim 4, further comprising:

a third light source unit including multiple light emitting diodes connected in parallel, the cathode of each light emitting diode being connected to the anode of the tail light emitting diode of the first light source unit; and a second characteristic setting unit for presetting the same information as that preset in the characteristic setting unit, wherein the positive connecting terminal includes a first positive connecting terminal connected to the anode of at least one light emitting diode of the third light source unit, and a second positive connecting terminal connected to the anode of at least one light emitting diode among the multiple light emitting diodes of the third light source unit which is not connected to the first positive connecting terminal; and the second characteristic setting unit is connected between the first and the second positive connecting terminal, wherein the first and the second positive connecting terminal are respectively connected to the cathodes of at least two light emitting diodes among the multiple light emitting diodes of the second light source unit which are not connected to both the first and the second negative connecting terminal, and the first and the second negative connecting terminal are respectively connected to the anodes of the at least two light emitting diodes among the multiple light emitting diodes of the third light source unit which are not connected to both the first and the second positive connecting terminal.

6. A lighting apparatus capable of turning on the light source module of claim 5, the lighting apparatus comprising:

a voltage conversion unit for applying a direct-current power between the first negative connecting terminal or the second negative connecting terminal and the first positive connecting terminal or the second positive connecting terminal, both voltage and current of the direct-current power being varied;

a set-up power supply unit for applying a direct-current voltage between the first and the second negative connecting terminal or between the first and the second positive connecting terminal;

a characteristic detection unit for detecting the electrical characteristic of the light emitting diodes preset in the characteristic setting unit based on the voltage waveform between the first and the second negative connecting terminal or between the first and the second positive connecting terminal;

a connection determination unit for determining whether or not the light source module is connected based on the voltage between the first and the second negative connecting terminal or between the first and the second positive connecting terminal; and an output control unit for stopping outputting the direct-current power of the voltage conversion unit if the connection determination unit determines that the light source module is not connected and for controlling at least either the voltage or the current of the direct-current power of the voltage conversion unit based on the electrical characteristic preset in the characteristic detection unit if the connection determination unit determines that the light source module is connected.

7. An illumination apparatus comprising:

an apparatus main body for receiving the lighting apparatus of claim 6; and a socket provided in the apparatus main body, wherein the light source module is detachably installed in the socket.

8. A lighting apparatus capable of turning on the light source module of claim 4, the lighting apparatus comprising:

a voltage conversion unit for applying a direct-current power between the first negative connecting terminal or the second negative connecting terminal and the positive connecting terminal, both voltage and current of the direct-current power being varied;

a set-up power supply unit for applying a direct-current voltage between the first and the second negative connecting terminal;

a characteristic detection unit for detecting the electrical characteristic of the light emitting diodes preset in the characteristic setting unit based on the voltage waveform between the first and the second negative connecting terminal;

a connection determination unit for determining whether or not the light source module is connected based on the voltage between the first and the second negative connecting terminal; and an output control unit for stopping outputting the direct-current power of the voltage conversion unit if the connection determination unit determines that the light source module is not connected and for controlling at least either the voltage or the current of the direct-current power of the voltage conversion unit based on the electrical characteristic preset in the characteristic detection unit if the connection determination unit determines that the light source module is connected.

9. An illumination apparatus comprising:

an apparatus main body for receiving the lighting apparatus of claim 8; and a socket provided in the apparatus main body, wherein the light source module is detachably installed in the socket.

10. A light source module comprising:

a first light source unit including multiple light emitting diodes connected in series in the forward direction;

a second light source unit including multiple light emitting diodes connected in parallel, the anode of each light emitting diode being connected to the cathode of the head light emitting diode of the first light source unit;

a positive connecting terminal connected to the anode of the tail light emitting diode of the first light source unit;

a first negative connecting terminal connected to the cathode of at least one light emitting diode of the second light source unit;

a second negative connecting terminal connected to the cathode of at least one light emitting diode among the multiple light emitting diodes of the second light source unit which is not connected to the first negative connecting terminal; and a characteristic setting unit for setting information about electrical characteristics of the light emitting diodes of the first and the second light source unit, the characteristic setting unit being connected between the first and the second negative connecting terminal, wherein a power is applied between the positive connecting terminal and the first negative connecting terminal or the second negative connecting terminal by a lighting apparatus, a direct-current voltage is applied between the first and the second negative connecting terminal from an outside power supply, and the characteristic setting unit includes a full-wave rectifier disposed between the first and the second negative connecting terminal and controls a voltage waveform inputted through the full-wave rectifier based on the information, wherein the light source module further comprises:

a third light source unit including multiple light emitting diodes connected in parallel, the cathode of each light emitting diode being connected to the anode of the tail light emitting diode of the first light source unit; and a second characteristic setting unit for presetting the same information as that preset in the characteristic setting unit, wherein the positive connecting terminal includes a first positive connecting terminal connected to the anode of at least one light emitting diode of the third light source unit, and a second positive connecting terminal connected to the anode of at least one light emitting diode among the multiple light emitting diodes of the third light source unit which is not connected to the first positive connecting terminal; and the second characteristic setting unit is connected between the first and the second positive connecting terminal, and wherein the first and the second positive connecting terminal arc respectively connected to the cathodes of at least two light emitting diodes among the multiple light emitting diodes of the second light source unit which are not connected to both the first and the second negative connecting terminal, and the first and the second negative connecting terminal are respectively connected to the anodes of the at least two light emitting diodes among the multiple light emitting diodes of the third light source unit which are not connected to both the first and the second positive connecting terminal.

11. A lighting apparatus capable of turning on the light source module of claim 10, the lighting apparatus comprising:

a voltage conversion unit for applying a direct-current power between the first negative connecting terminal or the second negative connecting terminal and the first positive connecting terminal or the second positive connecting terminal, both voltage and current of the direct-current power being varied;

a set-up power supply unit for applying a direct-current voltage between the first and the second negative connecting terminal or between the first and the second positive connecting terminal;

a characteristic detection unit for detecting the electrical characteristic of the light emitting diodes preset in the characteristic setting unit based on the voltage waveform between the first and the second negative connecting terminal or between the first and the second positive connecting terminal;

a connection determination unit for determining whether or not the light source module is connected based on the voltage between the first and the second negative connecting terminal or between the first and the second positive connecting terminal; and an output control unit for stopping outputting the direct-current power of the voltage conversion unit if the connection determination unit determines that the light source module is not connected and for controlling at least either the voltage or the current of the direct-current power of the voltage conversion unit based on the electrical characteristic preset in the characteristic detection unit if the connection determination unit determines that the light source module is connected.

12. An illumination apparatus comprising:

an apparatus main body for receiving the lighting apparatus of claim 11; and a socket provided in the apparatus main body, wherein the light source module is detachably installed in the socket.

* * * * *